US008548366B2

(12) United States Patent
Tokuda et al.

(10) Patent No.: US 8,548,366 B2
(45) Date of Patent: Oct. 1, 2013

(54) FIXING DEVICE AND IMAGE FORMING APPARATUS INCORPORATING SAME

(75) Inventors: Tetsuo Tokuda, Kanagawa (JP); Masaaki Yoshikawa, Tokyo (JP); Kenji Ishii, Kanagawa (JP); Hiroshi Yoshinaga, Chiba (JP); Naoki Iwaya, Tokyo (JP); Yoshiki Yamaguchi, Kanagawa (JP); Yutaka Ikebuchi, Kanagawa (JP); Takahiro Imada, Kanagawa (JP); Takamasa Hase, Kanagawa (JP); Ippei Fujimoto, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 316 days.

(21) Appl. No.: 13/016,342

(22) Filed: Jan. 28, 2011

(65) Prior Publication Data

US 2011/0217093 A1 Sep. 8, 2011

(30) Foreign Application Priority Data

Mar. 3, 2010 (JP) ..... 2010-046534

(51) Int. Cl.
*G03G 15/20* (2006.01)

(52) U.S. Cl.
USPC ..... 399/329

(58) Field of Classification Search
USPC ..... 399/329
See application file for complete search history.

(56) References Cited

U.S. PATENT DOCUMENTS

| | | | | |
|---|---|---|---|---|
| 5,355,204 | A * | 10/1994 | Aoki | 399/329 |
| 6,266,510 | B1 * | 7/2001 | Curry et al. | 399/329 |
| 7,177,579 | B2 * | 2/2007 | Uchida et al. | 399/328 |
| 7,447,474 | B2 * | 11/2008 | Fujino | 399/329 |
| 8,331,841 | B2 * | 12/2012 | Maruko et al. | 399/329 |
| 2003/0183610 | A1 * | 10/2003 | Okabayashi et al. | 219/216 |
| 2004/0223795 | A1 * | 11/2004 | Ono et al. | 399/329 |
| 2010/0092220 | A1 * | 4/2010 | Hasegawa et al. | 399/328 |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |

FOREIGN PATENT DOCUMENTS

| | | |
|---|---|---|
| JP | 10-213984 | 8/1998 |
| JP | 2884714 | 2/1999 |
| JP | 3298354 | 4/2002 |
| JP | 2002-311735 | 10/2002 |
| JP | 3592485 | 9/2004 |

(Continued)

OTHER PUBLICATIONS

U.S. Appl. No. 12/841,593, filed Jul. 22, 2010, Masaaki Yoshikawa et al.

*Primary Examiner* — Clayton E LaBalle
*Assistant Examiner* — Leon W Rhodes, Jr
(74) *Attorney, Agent, or Firm* — Oblon, Spivak, McClelland, Maier & Neustadt, L.L.P.

(57) ABSTRACT

A fixing device includes a fixing member formed into a loop inside which a nip formation member, a core holder, a heater support, and a laminated heater are provided, and a pressing member provided outside the loop formed by the fixing member. The pressing member is pressed against the nip formation member via the fixing member. The heater support is between the laminated heater and the nip formation member to support the laminated heater. The core holder is between the nip formation member and the heater support to support the nip formation member and the heater support.

17 Claims, 9 Drawing Sheets

(56) References Cited

FOREIGN PATENT DOCUMENTS

| | | |
|---|---|---|
| JP | 2007-334205 | 12/2007 |
| JP | 2008-158482 | 7/2008 |
| JP | 2008-216928 | 9/2008 |
| JP | 2008-310051 | 12/2008 |

* cited by examiner

FIG. 10A
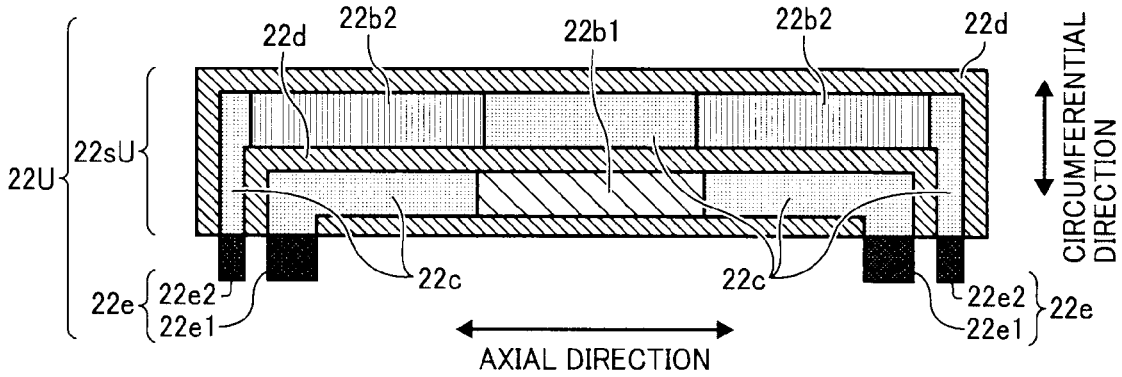
FIG. 10B
ELEMENTS OF DIVIDED REGIONS
| | | |
|---|---|---|
| (2, 1) | (2, 2) | (2, 3) |
| (1, 1) | (1, 2) | (1, 3) |
FIG. 11
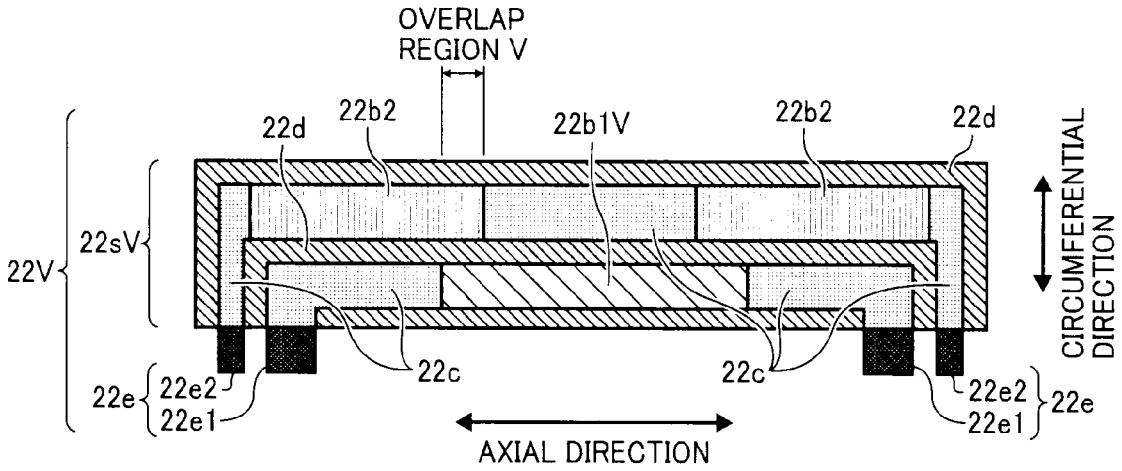

FIXING DEVICE AND IMAGE FORMING APPARATUS INCORPORATING SAME

CROSS-REFERENCE TO RELATED APPLICATIONS

The present application is based on and claims priority to Japanese Patent Application No. 2010-046534, filed on Mar. 3, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a flexible, endless fixing belt faulted into a loop and a resistant heat generator provided inside the loop formed by the fixing belt to heat the fixing belt, to shorten a warm-up time or a time to first print (hereinafter also "first print time"). Specifically, the resistant heat generator faces the inner circumferential surface of the fixing belt across a slight gap through which radiation heat generated by the resistant heat generator is transmitted to the fixing belt quickly. A pressing roller presses against a nip formation member also provided inside the loop formed by the fixing belt via the fixing belt to form a nip between the fixing belt and the pressing roller through which the recording medium bearing the toner image passes. As the recording medium bearing the toner image passes through the nip, the fixing belt heated by radiation heat generated by the resistant heat generator and the pressing roller apply heat and pressure to the recording medium to fix the toner image on the recording medium.

With the above configuration, the slight gap provided between the resistant heat generator and the fixing belt prevents wear of the resistant heat generator and the fixing belt while at the same time providing the shortened warm-up time and the shortened first print time described above. Accordingly, even when the fixing belt rotates at a high speed, the resistant heat generator heats the fixing belt to a desired fixing temperature with reduced wear of the fixing belt and the resistant heat generator.

However, the fixing device including the resistant heat generator and the fixing belt has a drawback in that the flexible fixing belt may partially contact the resistant heat generator as the fixing belt rotates because there is only a slight gap between the resistant heat generator and the fixing belt to transmit heat from the resistant heat generator to the fixing belt effectively. Accordingly, a part of the fixing belt that contacts the resistant heat generator is exposed to excessive heat from the resistant heat generator. In other words, the fixing belt is not heated uniformly, resulting in uneven temperature distribution over the fixing belt.

Moreover, rotation and vibration of the pressing roller repeatedly applies mechanical stress to the resistant heat generator via the fixing belt, which bends the resistant heat generator. The repeated bending of the resistant heat generator causes fatigue failure and concomitant breakage or disconnection of the wiring of the resistant heat generator, resulting in faulty heating of the fixing belt.

BRIEF SUMMARY OF THE INVENTION

This specification describes below an improved fixing device. In one exemplary embodiment of the present invention, the fixing device fixes a toner image on a recording medium and includes an endless belt-shaped fixing member, a nip formation member, a pressing member, a laminated heater, a heater support, and a core holder. The endless belt-shaped fixing member rotates in a predetermined direction of rotation, and is formed into a loop. The nip formation member is provided inside the loop formed by the fixing member. The pressing member is provided outside the loop formed by the fixing member to apply pressure to the nip formation member to press the fixing member against the nip formation member to form a nip between the pressing member and the fixing member through which the recording medium bearing the toner image passes. The laminated heater faces an inner circumferential surface of the fixing member to heat the fixing member. The heater support is provided inside the loop foamed by the fixing member between the laminated heater and the nip formation member to support the laminated heater at a position opposite the nip formation member via an axis of the fixing member in a state in which the laminated heater is provided between the fixing member and the heater support. The core holder is provided inside the loop formed by the fixing member between the nip formation member and the heater support, and is supported by a frame of the fixing device at lateral ends of the core holder in an axial direction of the fixing member. The core holder has a predetermined width in the axial direction of the fixing member to support the nip formation member and the heater support.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 10A is a plan view of a laminated heater as a first variation of the laminated heater shown in FIG. 4;

FIG. 10B is a lookup table of a matrix showing regions on the laminated heater shown in FIG. 10A;

FIG. 11 is a plan view of a laminated heater as a second variation of the laminated heater shown in FIG. 4;

DETAILED DESCRIPTION OF THE INVENTION

Figure 1:
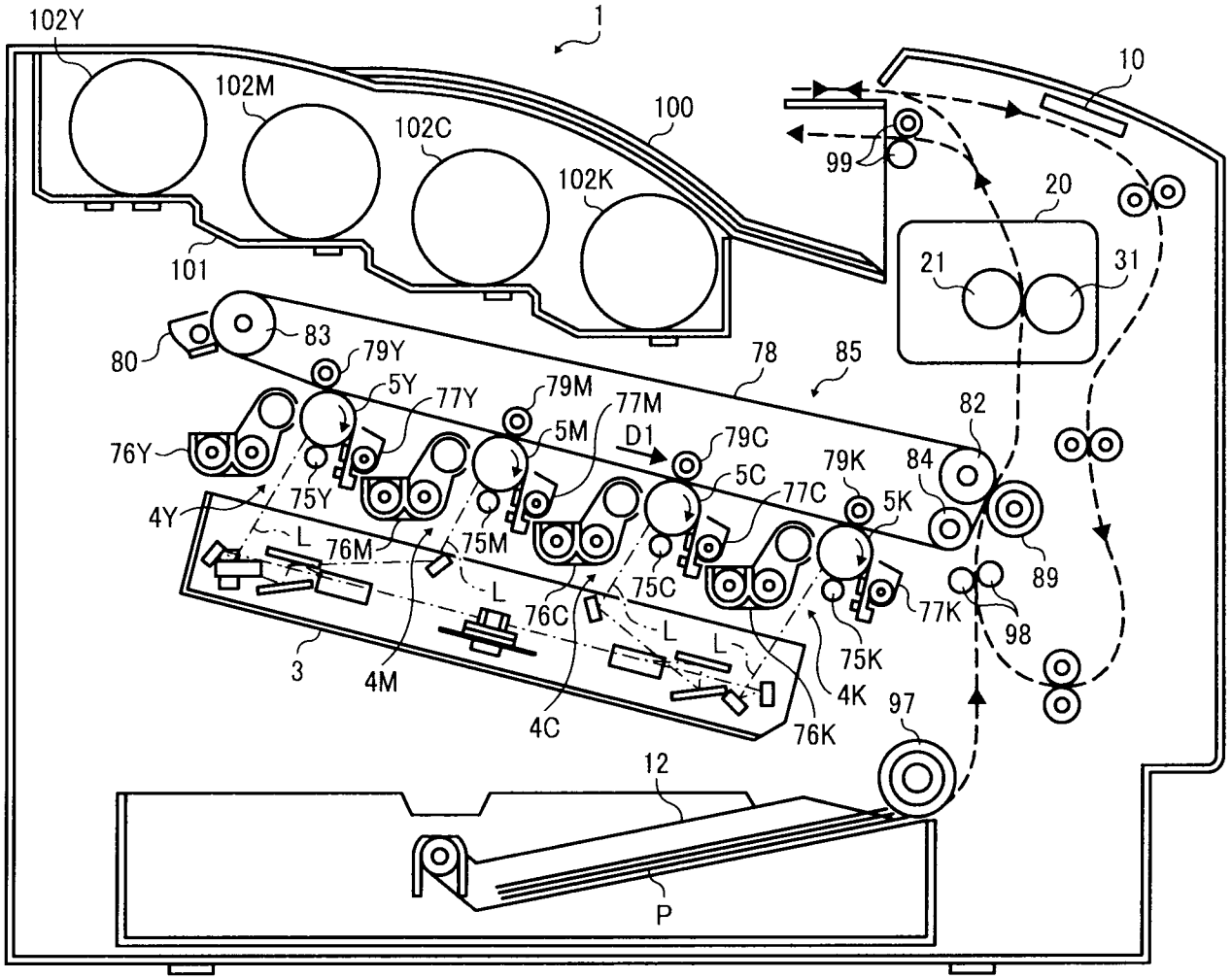
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 1, the image forming apparatus 1 includes image forming devices 4Y, 4M, 4C, and 4K provided in a center portion of the image forming apparatus 1, a toner bottle holder 101 provided above the image forming devices 4Y, 4M, 4C, and 4K in an upper portion of the image forming apparatus 1, an exposure device 3 provided below the image forming devices 4Y, 4M, 4C, and 4K, a paper tray 12 provided below the exposure device 3 in a lower portion of the image forming apparatus 1, an intermediate transfer unit 85 provided above the image forming devices 4Y, 4M, 4C, and 4K, a second transfer roller 89 disposed opposite the intermediate transfer unit 85, a feed roller 97 and a registration roller pair 98 provided between the paper tray 12 and the second transfer roller 89 in a recording medium conveyance direction, a fixing device 20 provided above the second transfer roller 89, an output roller pair 99 provided above the fixing device 20, a stack portion 100 provided downstream from the output roller pair 99 in the recording medium conveyance direction on top of the image forming apparatus 1, and a controller 10 provided in the upper portion of the image forming apparatus 1.

The toner bottle holder 101 includes toner bottles 102Y, 102M, 102C, and 102K. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101, and includes an intermediate transfer belt 78 formed into a loop, four first transfer bias rollers 79Y, 79M, 79C, and 79K, a second transfer backup roller 82, a cleaning backup roller 83, and a tension roller 84 provided inside the loop formed by the intermediate transfer belt 78, and an intermediate transfer cleaner 80 provided outside the loop formed by the intermediate transfer belt 78. Specifically, the intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction D1.

The image forming devices 4Y, 4M, 4C, and 4K are arranged opposite the intermediate transfer belt 78, and form yellow, magenta, cyan, and black toner images, respectively. The image forming devices 4Y, 4M, 4C, and 4K include photoconductive drums 5Y, 5M, 5C, and 5K which are surrounded by chargers 75Y, 75M, 75C, and 75K, development devices 76Y, 76M, 76C, and 76K, cleaners 77Y, 77M, 77C, and 77K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively, as a driving motor drives and rotates the photoconductive drums 5Y, 5M, 5C, and 5K clockwise in FIG. 1.

Specifically, in the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the respective photoconductive drums 5Y, 5M, 5C, and 5K according to image data sent from a client computer, for example. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the primary transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 78. The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The second transfer roller 89 is pressed against the second transfer backup roller 82 via the intermediate transfer belt 78 in such a manner that the second transfer roller 89 and the second transfer backup roller 82 sandwich the intermediate transfer belt 78 to form a second transfer nip between the second transfer roller 89 and the intermediate transfer belt 78. At the second transfer nip, the second transfer roller 89 secondarily transfers the color toner image formed on the intermediate transfer belt 78 onto a recording medium P sent from the paper tray 12 through the feed roller 97 and the registration roller pair 98 in the secondary transfer process. Thus, the desired color toner image is formed on the recording medium P. After the transfer of the color toner image, residual toner, which has not been transferred onto the recording medium P, remains on the intermediate transfer belt 78.

Thereafter, the intermediate transfer cleaner 80 collects the residual toner from the intermediate transfer belt 78 at a cleaning position at which the intermediate transfer cleaner 80 is disposed opposite the cleaning backup roller 83 via the intermediate transfer belt 78, thus completing a single sequence of transfer processes performed on the intermediate transfer belt 78.

The recording medium P is supplied to the second transfer nip from the paper tray 12 which loads a plurality of recording media P (e.g., transfer sheets). Specifically, the feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

After the secondary transfer process described above, the recording medium P bearing the color toner image is sent to the fixing device 20 that includes a fixing sleeve 21 and a pressing roller 31. The fixing sleeve 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 2:
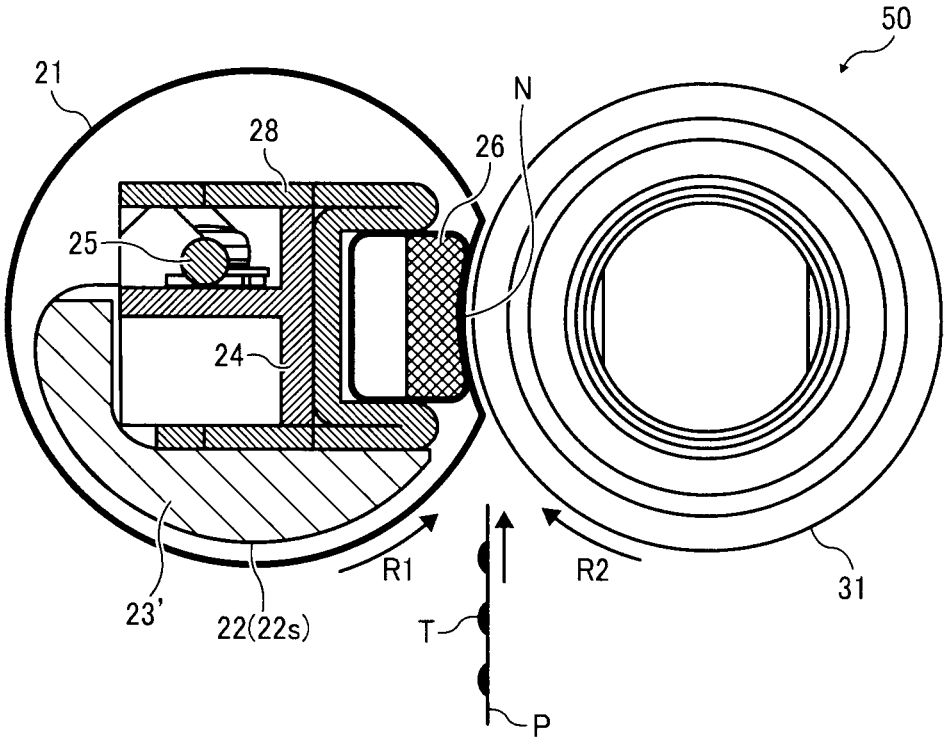
FIG. 2 is a vertical sectional view of a comparative fixing device.

Referring to FIG. 2, the following describes the structure of a comparative fixing device 50 that is comparative to the fixing device 20 depicted in FIG. 1.

FIG. 2 is a vertical sectional view of the comparative fixing device 50. As illustrated in FIG. 2, the comparative fixing device 50 includes the fixing sleeve 21 formed into a loop, a laminated heater 22, a heater support 23', a terminal stay 24, a power supply wire 25, a nip formation member 26, and a core holder 28, which are provided inside the loop formed by the fixing sleeve 21, and the pressing roller 31 provided outside the loop formed by the fixing sleeve 21.

As illustrated in FIG. 2, the fixing sleeve 21 is a rotatable endless belt serving as a fixing member or a rotary fixing member. The pressing roller 31 serves as a pressing member or a rotary pressing member that contacts an outer circumferential surface of the fixing sleeve 21. The nip formation member 26 faces an inner circumferential surface of the fixing sleeve 21, and is pressed against the pressing roller 31 via the fixing sleeve 21 to form a nip N between the pressing roller 31 and the fixing sleeve 21 through which the recording medium P bearing a toner image T passes. The laminated heater 22 also faces the inner circumferential surface of the fixing sleeve 21, and is capable of contacting or being disposed close to the inner circumferential surface of the fixing sleeve 21 to heat the fixing sleeve 21 directly or indirectly. The heater support 23' faces the inner circumferential surface of the fixing sleeve 21 to support the laminated heater 22 at a predetermined position in such a manner that the laminated heater 22 is provided between the heater support 23' and the fixing sleeve 21. FIG. 2 illustrates the laminated heater 22 being isolated from the inner circumferential surface of the fixing sleeve 21 to distinguish the laminated heater 22 from the fixing sleeve 21. However, practically, the laminated heater 22 contacts the inner circumferential surface of the fixing sleeve 21 to heat the fixing sleeve 21 directly.

Figure 3A:
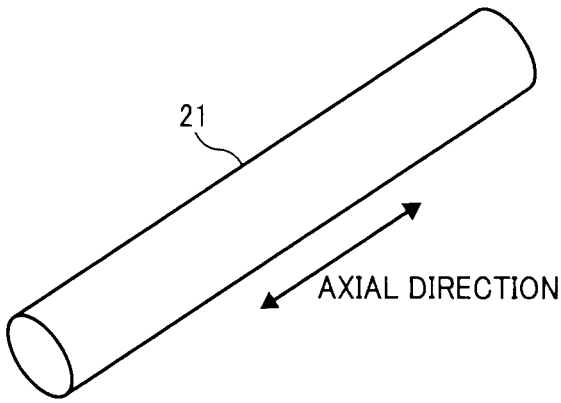
FIG. 3A is a perspective view of a fixing sleeve included in the comparative fixing device shown in FIG. 2.
Figure 3B:
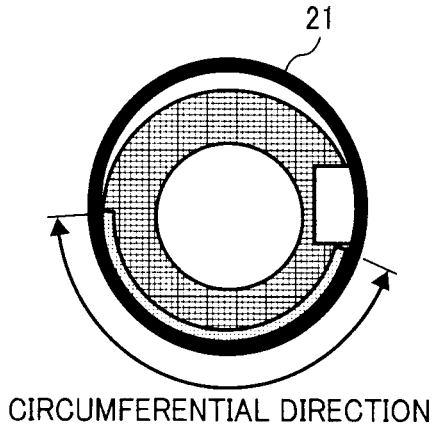
FIG. 3B is a vertical sectional view of the fixing sleeve shown in FIG. 3A.

Referring to FIGS. 3A and 3B, the following describes the fixing sleeve 21. FIG. 3A is a perspective view of the fixing sleeve 21. FIG. 3B is a vertical sectional view of the fixing sleeve 21. As illustrated in FIG. 3A, the fixing sleeve 21 is the flexible, pipe-shaped or cylindrical endless belt having a predetermined width in an axial direction of the fixing sleeve 21, which corresponds to a width of a recording medium P passing through the nip N formed between the fixing sleeve 21 and the pressing roller 31 depicted in FIG. 2. As illustrated in FIG. 3A, the axial direction of the pipe-shaped fixing sleeve 21 corresponds to a long axis, that is, a longitudinal direction, of the fixing sleeve 21. As illustrated in FIG. 3B, a circumferential direction of the pipe-shaped fixing sleeve 21 extends along a circumference of the fixing sleeve 21.

For example, the fixing sleeve 21 has an outer diameter of about 30 mm, and is constructed of a base layer made of a metal material and having a thickness in a range of from about 30 μm to about 50 μm, and at least a release layer provided on the base layer. The base layer of the fixing sleeve 21 is made of a conductive metal material such as iron, cobalt, nickel, an alloy of those, or the like. The release layer of the fixing sleeve 21 has a thickness in a range of from about 10 μm to about 50 μm, and is made of tetrafluoroethylene-perfluoroalkylvinylether copolymer (PFA), polytetrafluoroethylene (PTFE), polyimide, polyetherimide, polyether sulfide (PES), or the like. The release layer facilitates separation of toner of the toner image T on the recording medium P, which contacts the outer circumferential surface of the fixing sleeve 21 directly, from the fixing sleeve 21.

On the other hand, the pressing roller 31 depicted in FIG. 2 has an outer diameter of about 30 mm, and is constructed of a metal core made of a metal material such as aluminum or copper; a heat-resistant elastic layer provided on the metal core and made of silicon rubber (e.g., solid rubber); and a release layer provided on the elastic layer. The elastic layer has a thickness of about 2 mm. The release layer is a PFA tube covering the elastic layer and has a thickness of about 50 μm. Optionally, a heat generator, such as a halogen heater, may be provided inside the metal core as needed.

The pressing roller 31 is connected to a pressure apply-release mechanism that applies pressure to the pressing roller 31 to cause the pressing roller 31 to contact the outer circumferential surface of the fixing sleeve 21 and releases the pressure to separate the pressing roller 31 from the fixing sleeve 21. Specifically, the pressure apply-release mechanism applies pressure to the pressing roller 31 to press the pressing roller 31 against the nip formation member 26 via the fixing sleeve 21 in a state in which the pressing roller 31 contacts the outer circumferential surface of the fixing sleeve 21 to form the nip N between the pressing roller 31 and the fixing sleeve 21. For example, a portion of the pressing roller 31 contacting the fixing sleeve 21 causes a concave portion of the fixing sleeve 21 at the nip N. Thus, the recording medium P passing through the nip N moves along the concave portion of the fixing sleeve 21. By contrast, the pressure apply-release mechanism releases the pressure applied to the pressing roller 31 to separate the pressing roller 31 from the outer circumferential surface of the fixing sleeve 21. Accordingly, the pressing roller 31 is not pressed against the nip formation member 26 via the fixing sleeve 21, and therefore the nip N is not formed between the pressing roller 31 and the fixing sleeve 21.

A driving mechanism drives and rotates the pressing roller 31, which presses the fixing sleeve 21 against the nip formation member 26, clockwise in FIG. 2 in a rotation direction R2. Accordingly, the fixing sleeve 21 rotates in accordance with rotation of the pressing roller 31 counterclockwise in FIG. 2 in a rotation direction R1.

A longitudinal direction of the nip formation member 26 is parallel to the axial direction of the fixing sleeve 21. At least a portion of the nip formation member 26 which is pressed against the pressing roller 31 via the fixing sleeve 21 is made of a heat-resistant elastic material such as fluorocarbon rubber. The core holder 28 holds and supports the nip formation member 26 at a predetermined position inside the loop formed by the fixing sleeve 21. Preferably, a portion of the nip formation member 26 which contacts the inner circumferential surface of the fixing sleeve 21 is made of a slidable and durable material such as Teflon® sheet.

The core holder 28 is made of sheet metal, and has a predetermined width in a longitudinal direction thereof, corresponding to the width of the fixing sleeve 21 in the axial direction of the fixing sleeve 21. The core holder 28 is a rigid member having an H-like shape in cross-section, and is provided at substantially a center position inside the loop formed by the fixing sleeve 21. Lateral end portions of the core holder 28 in the longitudinal direction of the core holder 28 are supported by a frame of the comparative fixing device 50.

The core holder 28 holds the respective components provided inside the loop formed by the fixing sleeve 21 at predetermined positions. For example, the H-shaped core holder 28 includes a first concave portion facing the pressing roller 31, which houses and holds the nip formation member 26. In other words, the core holder 28 is disposed opposite the pressing roller 31 via the nip formation member 26 to support the nip formation member 26 at a back face of the nip formation member 26 disposed back-to-back to a front face of the nip formation member 26 facing the nip N. Accordingly, even when the pressing roller 31 presses the fixing sleeve 21 against the nip formation member 26, the core holder 28 prevents substantial deformation of the nip formation member 26. In addition, the nip formation member 26 held by the core holder 28 protrudes from the core holder 28 slightly toward the pressing roller 31 to isolate the core holder 28 from the fixing sleeve 21 without contacting the fixing sleeve 21 at the nip N.

The H-shaped core holder 28 further includes a second concave portion disposed back-to-back to the first concave portion, which houses and holds the terminal stay 24 and the power supply wire 25. The terminal stay 24 has a predetermined width in a longitudinal direction thereof, corresponding to the width of the fixing sleeve 21 in the axial direction of the fixing sleeve 21, and is T-shaped in cross-section. The power supply wire 25 extends on the terminal stay 24, and transmits power supplied from an outside of the comparative fixing device 50. A part of an outer circumferential surface of the core holder 28 holds the heater support 23' that supports the laminated heater 22. In FIG. 2, the core holder 28 holds the heater support 23' in a lower half region inside the loop formed by the fixing sleeve 21, that is, in a semicircular region provided upstream from the nip N in the rotation direction R1 of the fixing sleeve 21. The heater support 23' can be adhered to the core holder 28 to facilitate assembly. Alternatively, the heater support 23' may not be adhered to the core holder 28 to suppress heat transmission from the heater support 23' to the core holder 28. For example, the heater support 23' may be secured to the core holder 28 with screws.

The heater support 23' supports the laminated heater 22 in such a manner that the laminated heater 22 contacts the inner circumferential surface of the fixing sleeve 21. Accordingly, the heater support 23' includes an arc-shaped outer circumferential surface having a predetermined circumferential length and disposed along the inner circumferential surface of the circular fixing sleeve 21 in cross-section.

Preferably, the heater support 23' has a heat resistance that resists heat generated by the laminated heater 22, a strength sufficient to support the laminated heater 22 without being deformed by the fixing sleeve 21 even when the rotating fixing sleeve 21 contacts the laminated heater 22, and sufficient heat insulation so that heat generated by the laminated heater 22 is not transmitted to the core holder 28 but heat is transmitted to the fixing sleeve 21. For example, the heater support 23' may be molded foam made of polyimide resin. Alternatively, a supplemental solid resin member may be provided inside the molded foam made of polyimide resin to improve rigidity.

Figure 4:
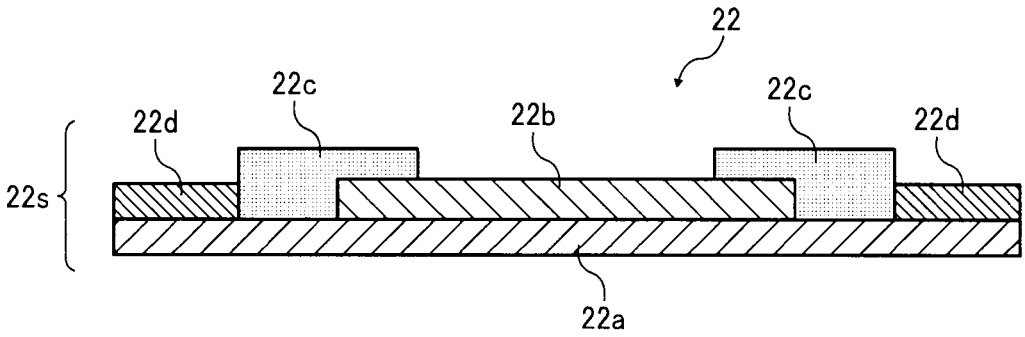
FIG. 4 is a sectional view of a laminated heater included in the comparative fixing device shown in FIG. 2.

Referring to FIG. 4, the following describes the laminated heater 22. FIG. 4 is a sectional view of the laminated heater 22. As illustrated in FIG. 4, the laminated heater 22 includes a heat generation sheet 22*s* constructed of a base layer 22*a* having insulation; a resistant heat generation layer 22*b* provided on the base layer 22*a* and including conductive particles dispersed in a heat-resistant resin; an electrode layer 22*c* provided on the base layer 22*a* to supply power to the resistant heat generation layer 22*b*; and an insulation layer 22*d* provided on the base layer 22*a*. The heat generation sheet 22*s* is flexible, and has a predetermined width in the axial direction of the fixing sleeve 21 depicted in FIG. 3A and a predetermined length in the circumferential direction of the fixing sleeve 21 depicted in FIG. 3B. The insulation layer 22*d* insulates one resistant heat generation layer 22*b* from the adjacent electrode layer 22*c* of a different power supply system, and insulates an edge of the heat generation sheet 22*s* from an outside of the heat generation sheet 22*s*.

The heat generation sheet 22*s* has a thickness in a range of from about 0.1 mm to about 1.0 mm, and has flexibility sufficient to wrap around the heater support 23' depicted in FIG. 2 at least along an outer circumferential surface of the heater support 23'.

The base layer 22*a* is a thin, elastic film made of a resin having a certain level of heat resistance, such as polyethylene terephthalate (PET) or polyimide resin. For example, the base layer 22*a* may be a film made of polyimide resin to provide heat resistance, insulation, and a certain level of flexibility.

The resistant heat generation layer 22*b* is a thin, conductive film in which conductive particles, such as carbon particles and metal particles, are uniformly dispersed in a heat-resistant resin such as polyimide resin. When power is supplied to the resistant heat generation layer 22*b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor made of a heat-resistant resin such as polyimide resin.

Alternatively, the resistant heat generation layer 22*b* may be manufactured by providing a thin conductive layer made of carbon particles and/or metal particles on the base layer 22*a* and then providing a thin insulation film made of a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles formed of at least one of carbon nanofiber, carbon nanotube, and carbon microcoil.

The metal particles used in the resistant heat generation layer 22*b* may be silver, aluminum, or nickel particles, and may be granular or filament-shaped.

The insulation layer 22*d* may be manufactured by coating the base layer 22*a* with an insulation material including a heat-resistant resin identical to the heat-resistant resin of the base layer 22*a*, such as polyimide resin.

The electrode layer 22*c* may be manufactured by coating the base layer 22*a* with a conductive ink or a conductive paste such as silver. Alternatively, metal foil or a metal mesh may be adhered to the base layer 22*a*.

The heat generation sheet 22*s* of the laminated heater 22 is a thin sheet having a small heat capacity, and is heated quickly. An amount of heat generated by the heat generation sheet 22*s* is arbitrarily set according to the volume resistivity of the resistant heat generation layer 22*b*. In other words, the amount of heat generated by the heat generation sheet 22*s* can be adjusted according to the material, shape, size, and dispersion of conductive particles of the resistant heat generation layer 22*b*. For example, the laminated heater 22 providing heat generation per unit area of 35 W/cm$^2$ outputs a total power of about 1,200 W with the heat generation sheet 22*s* having a width of about 20 cm in the axial direction of the fixing sleeve 21 and a length of about 2 cm in the circumferential direction of the fixing sleeve 21, for example.

If a metal filament, such as a stainless steel filament, is used as a laminated heater, the metal filament causes asperities to appear on a surface of the laminated heater. Consequently, when the inner circumferential surface of the fixing sleeve 21 slides over the laminated heater, the asperities of the laminated heater abrade the surface of the laminated heater easily. To address this problem, the heat generation sheet 22*s* has a smooth surface without asperities as described above, improving durability in particular against wear due to sliding of the inner circumferential surface of the fixing sleeve 21 over the laminated heater 22. Further, a surface of the resistant heat generation layer 22*b* of the heat generation sheet 22*s* may be coated with fluorocarbon resin to further improve durability.

In FIG. 2, the heat generation sheet 22*s* of the laminated heater 22 faces the inner circumferential surface of the fixing sleeve 21 in a region in the circumferential direction of the fixing sleeve 21 between a position on the fixing sleeve 21 opposite the nip N via an axis of the fixing sleeve 21 and a position immediately upstream from the nip N in the rotation direction R1 of the fixing sleeve 21.

With the above-described configuration, the comparative fixing device 50 shortens a warm-up time and a first print time while at the same time saving energy. Further, since the heat generation sheet 22*s* of the laminated heater 22 is made of resin, even when rotation and vibration of the pressing roller 31 apply stress to the heat generation sheet 22*s* repeatedly, and therefore bend the heat generation sheet 22*s* repeatedly, the heat generation sheet 22*s* is not damaged due to fatigue failure and concomitant breakage, providing long-duration operation.

However, in the comparative fixing device 50, temperature fluctuation may arise on the fixing sleeve 21 in the axial direction of the fixing sleeve 21, destabilizing the fixing process. The temperature fluctuation on the fixing sleeve 21 is caused by unstable contact of the fixing sleeve 21 with the sheet heat generator 22*s*. Specifically, when the fixing sleeve 21 rotates in accordance with rotation of the pressing roller 31, a rotational force of the pressing roller 31 pulls and stretches an upstream portion of the fixing sleeve 21 provided upstream from the nip N in the rotation direction R1 of the fixing sleeve 21 toward the nip N. Accordingly, the upstream portion of the fixing sleeve 21 is moved toward the heater support 23', and therefore the fixing sleeve 21 contacts the heat generation sheet 22*s* of the laminated heater 22. The hardness of rubber included in the fixing sleeve 21 is softer than that of rubber included in the pressing roller 31 forming the nip N. As the hardness of rubber included in the nip formation member 26 decreases over time due to friction between the nip formation member 26 and the fixing sleeve 21 sliding over the nip formation member 26, a position of the nip formation member 26 with respect to the nip N is changed, and therefore a position of the fixing sleeve 21 with respect to the nip N is also changed. Accordingly, tension of the fixing sleeve 21 is changed, changing pressure applied by the fixing sleeve 21 to the laminated heater 22. As a result, the fixing sleeve 21 contacts the heat generation sheet 22*s* of the laminated heater 22 unstably. To address this problem, a tension adjustment mechanism that adjusts the tension of the fixing sleeve 21 may be provided in the comparative fixing device 50. However, such tension adjustment mechanism may complicate the structure of the comparative fixing device 50.

Moreover, the changed tension of the fixing sleeve 21 may cause another problem, in that the fixing sleeve 21 does not contact the laminated heater 22 uniformly in the axial direction of the fixing sleeve 21, varying heat transmission from the laminated heater 22 to the fixing sleeve 21 in the axial direction of the fixing sleeve 21, and resulting in temperature variation of the fixing sleeve 21 in the axial direction of the fixing sleeve 21. For example, the laminated heater 22 is partially isolated from the fixing sleeve 21, disturbing heat transmission from the laminated heater 22 to the fixing sleeve 21. Accordingly, the laminated heater 22 may be overheated locally, resulting in various malfunctions of the comparative fixing device 50.

Figure 5:
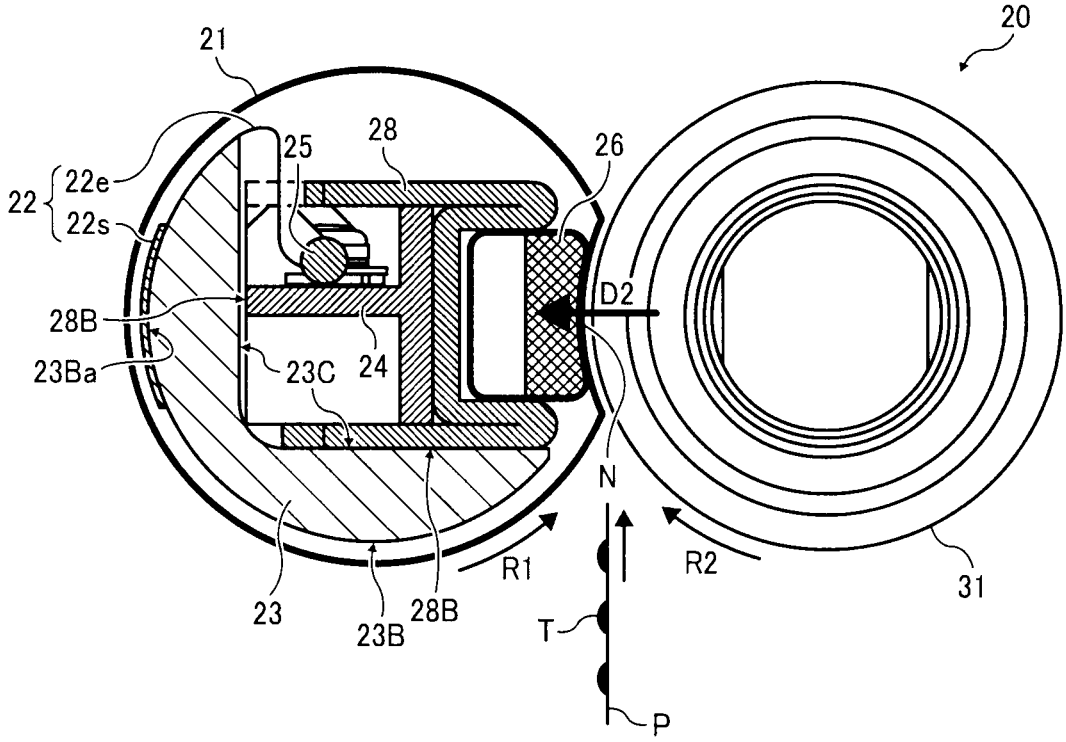
FIG. 5 is a vertical sectional view of a fixing device included in the image forming apparatus shown in FIG. 1.

To address the above-described problems, the fixing device 20 according to a first illustrative embodiment of the present invention, which is installed in the image forming apparatus 1 depicted in FIG. 1, has the structure described below. FIG. 5 is a vertical sectional view of the fixing device 20. As illustrated in FIG. 5, the fixing device 20 includes the fixing sleeve 21 foamed into a loop, the laminated heater 22, a heater support 23, the terminal stay 24, the power supply wire 25, the nip formation member 26, and the core holder 28, which are provided inside the loop formed by the fixing sleeve 21, and the pressing roller 31 provided outside the loop formed by the fixing sleeve 21.

The fixing device 20 is different from the comparative fixing device 50 depicted in FIG. 2 in that the fixing device 20 employs the heater support 23 instead of the heater support 23' and therefore the heat generation sheet 22*s* is disposed at a different position.

The fixing sleeve 21 is a rotatable endless belt serving as a fixing member or a rotary fixing member. The pressing roller 31 serves as a pressing member or a rotary pressing member that contacts the outer circumferential surface of the fixing sleeve 21 and presses the fixing sleeve 21 against the nip formation member 26. The nip formation member 26 faces the inner circumferential surface of the fixing sleeve 21, and is pressed against the pressing roller 31 via the fixing sleeve 21 to form the nip N between the pressing roller 31 and the fixing sleeve 21 through which the recording medium P bearing the toner image T passes. The laminated heater 22 including the heat generation sheet 22*s* also faces the inner circumferential surface of the fixing sleeve 21 in such a manner that the laminated heater 22 is capable of contacting the inner circumferential surface of the fixing sleeve 21 to heat the fixing sleeve 21. The heater support 23 faces the inner circumferential surface of the fixing sleeve 21 to support the laminated heater 22 at a position opposite the nip formation member 26 via the axis of the fixing sleeve 21 in such a manner that the laminated heater 22 is provided between the heater support 23 and the fixing sleeve 21. The core holder 28 has a predetermined width in the longitudinal direction thereof, corresponding to the width of the fixing sleeve 21 in the axial direction of the fixing sleeve 21. The lateral end portions of the core holder 28 in the longitudinal direction thereof are supported by a frame of the fixing device 20 in such a manner that the core holder 28 supports the nip formation member 26 and the heater support 23.

In the fixing device 20, the nip formation member 26, the core holder 28, the heater support 23, and the laminated heater 22 are aligned, in this order, in a pressure application direction indicated by arrow D2 in which the pressing roller 31 applies pressure to the nip formation member 26 via the fixing sleeve 21.

It is to be noted that the fixing sleeve 21, the terminal stay 24, the power supply wire 25, the nip formation member 26, the core holder 28, the pressing roller 31, and the pressure apply-release mechanism connected to the pressing roller 31 of the fixing device 20 are identical to those of the comparative fixing device 50 depicted in FIG. 2. The fixing device 20 is different from the comparative fixing device 50 in that the fixing device 20 includes the heater support 23 instead of the heater support 23' depicted in FIG. 2 and the heater support 23 supports the laminated heater 22 at the position opposite the nip formation member 26 via the axis of the fixing sleeve 21.

As illustrated in FIG. 5, the laminated heater 22 includes the heat generation sheet 22*s* and a plurality of electrode terminal pairs 22*e*. The electrode terminal pairs 22*e* are provided at one edge of the heat generation sheet 22*s* and are connected to the electrode layers 22*c* depicted in FIG. 4 to transmit power supplied from the power supply wire 25 to the electrode layers 22*c*. The heat generation sheet 22*s* is supported by the heater support 23 in such a manner that the heat generation sheet 22*s* is capable of contacting the inner circumferential surface of the fixing sleeve 21. By contrast, the electrode terminal pairs 22*e* extending from the heat generation sheet 22*s* and connected to the power supply wire 25 are supported by the heater support 23 in such a manner that the electrode terminal pairs 22*e* do not contact the inner circumferential surface of the fixing sleeve 21.

The heat generation sheet 22*s* has the basic structure shown in FIG. 4 in which the heat generation sheet 22*s* has a heat generation region having at least a width corresponding to a width of a maximum recording medium that passes through the nip N in the axial direction of the fixing sleeve 21 and a predetermined length in the circumferential direction of the fixing sleeve 21.

Further, the heat generation sheet 22*s* has a thickness in a range of from about 0.1 mm to about 1.0 mm, which provides flexibility to allow the heat generation sheet 22*s* to be wound around an outer circumferential surface 23B of the heater support 23.

Referring to FIG. 5, the following describes the heater support 23. The heater support 23 supports the heat generation sheet 22*s* in such a manner that the heat generation sheet 22*s* contacts the inner circumferential surface of the fixing sleeve 21.

Preferably, the heater support 23 has a heat resistance that resists heat generated by the heat generation sheet 22*s*, a strength sufficient to support the heat generation sheet 22*s* without being deformed by the fixing sleeve 21 even when the rotating fixing sleeve 21 contacts the heat generation sheet 22*s*, and sufficient heat insulation so that heat generated by the heat generation sheet 22*s* is not transmitted to the core holder 28 but heat is transmitted to the fixing sleeve 21. For example, the heater support 23 may be molded with heat-resistant resin such as polyimide resin, heat-resistant polyethylene terephthalate (PET) resin, or liquid crystal polymer (LCP). Preferably, the heater support 23 is molded foam made of polyimide resin. Alternatively, a supplemental solid resin member may be provided inside the molded foam made of polyimide resin to improve rigidity.

The heater support 23 includes an arc-shaped sheet support portion 23Ba provided on the outer circumferential surface 23B of the heater support 23 to support the heat generation sheet 22*s* and having a predetermined length along the inner circumference surface of the fixing sleeve 21 that has a circular shape in cross-section in the circumferential direction of the fixing sleeve 21. The heater support 23 further includes a planar inner surface portion 23C disposed back-to-back to the arc-shaped sheet support portion 23Ba that supports the heat generation sheet 22*s*. The planar inner surface portion 23C extends straight in the axial direction of the fixing sleeve 21 and contacts an outer surface portion 28B of the core holder 28 throughout the entire longitudinal direction of the core holder 28 parallel to the axial direction of the fixing sleeve 21. As shown in FIG. 5, the heater support 23 is provided to the left of and below the core holder 28 in such a manner that one edge of the heater support 23 is provided near the nip N. The heater support 23 is adhered to a lower surface of the core holder 28 so that the heater support 23 is integrated with the core holder 28.

As noted above, the arc-shaped sheet support portion 23Ba on the outer circumferential surface 23B of the heater support 23, which supports the heat generation sheet 22*s*, is provided at a position opposite the nip formation member 26 via the axis of the fixing sleeve 21.

With the above-described configuration, the nip formation member 26, the core holder 28, the sheet support portion 23Ba of the heater support 23, and the heat generation sheet 22*s* are aligned in a diametrical direction (that is, along the cross-sectional diameter) of the fixing sleeve 21 inside the loop formed by the fixing sleeve 21 in a state in which each of the elements, that is, the nip formation member 26, the core holder 28, the sheet support portion 23Ba of the heater support 23, and the heat generation sheet 22*s*, contacts the adjacent element throughout the entire axial direction of the fixing sleeve 21. Further, the diametrical direction of the fixing sleeve 21 in which those elements are aligned coincides with the pressure application direction D2 in which the pressing roller 31 applies pressure to the nip formation member 26.

In the fixing device 20 having the above-described configuration, when the pressure apply-release mechanism applies pressure to the pressing roller 31 to press the pressing roller 31 against the nip formation member 26 to form the nip N between the pressing roller 31 and the fixing sleeve 21, the pressure is transmitted to the core holder 28 via the fixing sleeve 21 and the nip formation member 26. Since the core holder 28 serves as a beam including the lateral end portions in the longitudinal direction of the core holder 28 parallel to the axial direction of the fixing sleeve 21 supported by the frame of the fixing device 20, a center portion of the core holder 28 sandwiched between the lateral end portions of the core holder 28 in the longitudinal direction of the core holder 28 is bent like a bow by the pressure applied by the pressing roller 31 in the pressure application direction D2. Accordingly, the bent core holder 28 causes the heater support 23 to press the heat generation sheet 22*s* against the inner circumferential surface of the fixing sleeve 21. Consequently, the heat generation sheet 22*s* contacts the inner circumferential surface of the fixing sleeve 21 throughout the entire width of the heat generation sheet 22*s* in the axial direction of the fixing sleeve 21 with predetermined pressure or more, improving heat transmission efficiency of the heat generation sheet 22*s* for transmitting heat to the fixing sleeve 21. As a result, the heat generation sheet 22*s* can stably heat the fixing sleeve 21 that rotates in the rotation direction R1, improving fixing performance.

Figure 6A:
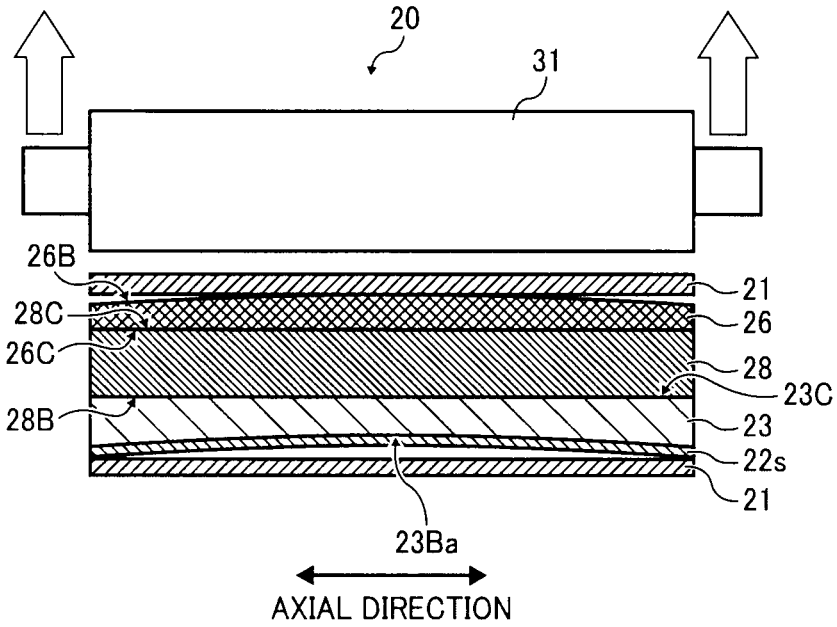
FIG. 6A is a horizontal sectional view of the fixing device shown in FIG. 5 when a pressing roller included in the fixing device does not apply pressure.
Figure 6B:
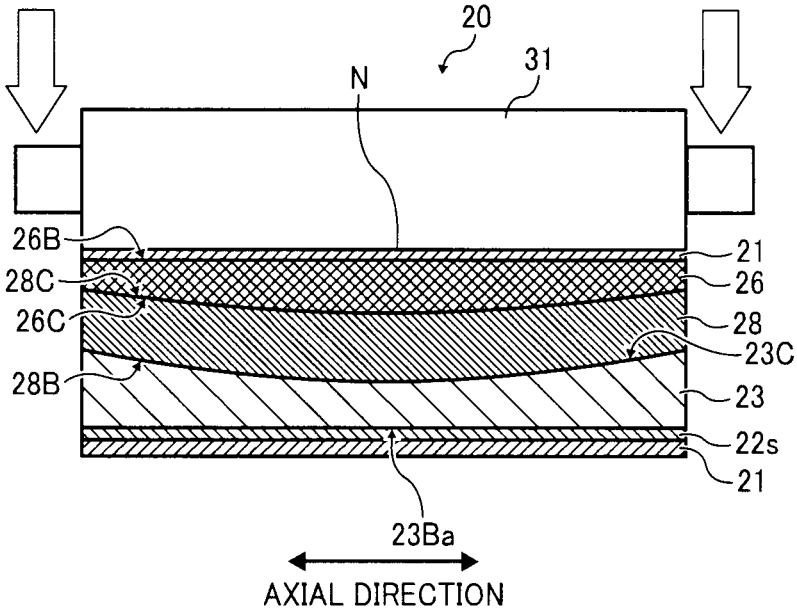
FIG. 6B is a horizontal sectional view of the fixing device shown in FIG. 5 when a pressing roller included in the fixing device applies pressure.

Referring to FIGS. 6A and 6B, the following describes in detail the alignment of the nip formation member 26, the core holder 28, the heater support 23, and the heat generation sheet 22*s* in detail. FIG. 6A is a horizontal sectional view of the fixing device 20 in the axial direction of the fixing sleeve 21 taken on the diametrical line of the fixing sleeve 21 when the pressing roller 31 is separated from and does not press the fixing sleeve 21 against the nip formation member 26. FIG. 6B is a horizontal sectional view of the fixing device 20 in the axial direction of the fixing sleeve 21 taken on the diametrical line of the fixing sleeve 21 when the pressing roller 31 presses the fixing sleeve 21 against the nip formation member 26.

As illustrated in FIG. 6A, when the pressing roller 31 does not press the fixing sleeve 21 against the nip formation member 26, the sheet support portion 23Ba of the heater support 23 is curved like a bow in such a manner that the sheet support portion 23Ba of the heater support 23 has a concave shape facing the heat generation sheet 22*s*. Accordingly, although lateral end portions of the heater support 23 in the axial direction of the fixing sleeve 21 press the heat generation sheet 22*s* against the fixing sleeve 21, a center portion of the heater support 23 in the axial direction of the fixing sleeve 21 is isolated from the fixing sleeve 21 at the non-nip side inner circumferential surface of the fixing sleeve 21. In other words, the heater support 23 separates from the non-nip side inner circumferential surface of the fixing sleeve 21 gradually from the lateral end portions toward the center portion of the heater support 23 in the axial direction of the fixing sleeve 21. Since the heat generation sheet 22*s* is supported by the sheet support portion 23Ba of the heater support 23 along the outer circumferential surface 23B (depicted in FIG. 5) of the heater support 23, the heat generation sheet 22*s* is also curved like a bow to have a concave shape facing the non-nip side inner circumferential surface of the fixing sleeve 21 in such a manner that the heat generation sheet 22*s* separates from the non-nip side inner circumferential surface of the fixing sleeve 21 gradually from lateral end portions toward a center portion of the heat generation sheet 22*s* in the axial direction of the fixing sleeve 21.

The heater support 23 is attached to the core holder 28 after the sheet support portion 23Ba of the heater support 23 which faces the heat generation sheet 22*s* is bent as illustrated in FIG. 6A or after the heater support 23 is molded into the bent shape as illustrated in FIG. 6A. By contrast, another face of the heater support 23 which faces the core holder 28, that is, the planar inner surface portion 23C, is planar in the axial direction of the fixing sleeve 21. Similarly, the outer surface portion 28B of the core holder 28 which faces the heater support 23 is also planar in the axial direction of the fixing sleeve 21.

With this configuration, when the pressing roller 31 applies pressure to the nip formation member 26 to press the fixing sleeve 21 against the nip formation member 26 as illustrated in FIG. 6B, the core holder 28 is bent by the pressure transmitted from the nip formation member 26 into a convex shape toward the heater support 23 in which the outer surface portion 28B of the core holder 28 which faces the heater support 23 is disposed gradually closer to the non-nip side inner circumferential surface of the fixing sleeve 21 from the lateral end portions toward the center portion of the core holder 28 in the axial direction of the fixing sleeve 21. As a result, the bent core holder 28 applies pressure to the heater support 23 non-uniformly in the axial direction of the fixing sleeve 21.

However, the heater support 23 bent by default as described above, that is, the concave-shaped sheet support portion 23Ba of the heater support 23 which faces the heat generation sheet 22*s*, effectively offsets the non-uniform pressure applied by the bent core holder 28 to the heater support 23 in the axial direction of the fixing sleeve 21. Accordingly, the sheet support portion 23Ba of the heater support 23, that is, a part of the outer circumferential surface 23B (depicted in FIG. 5) of the heater support 23 which faces the fixing sleeve 21, becomes planar or slightly convex toward the non-nip side inner circumferential surface of the fixing sleeve 21 at a center part of the sheet support portion 23Ba of the heater support 23 in the axial direction of the fixing sleeve 21. Consequently, the heat generation sheet 22*s* supported by the heater support 23 is pressed against the non-nip side inner circumferential surface of the fixing sleeve 21 with uniform pressure throughout the entire width of the fixing sleeve 21 in the axial direction of the fixing sleeve 21, and therefore heat is transmitted from the heat generation sheet 22*s* to the fixing sleeve 21 with uniform efficiency throughout the entire width of the fixing sleeve 21 in the axial direction of the fixing sleeve 21. In other words, the fixing sleeve 21 is heated by the heat generation sheet 22*s* uniformly in the axial direction of the fixing sleeve 21. As a result, the toner image T is fixed on the recording medium P properly throughout the entire width of the fixing sleeve 21 in the axial direction of the fixing sleeve 21, providing uniform gloss of the fixed toner image T. Further, the heat generation sheet 22*s* is not levitated or isolated from the fixing sleeve 21 locally, preventing overheating of the heat generation sheet 22*s* due to insufficient heat transmission from the levitated part of the heat generation sheet 22*s* to the fixing sleeve 21.

At the same time, when the pressing roller 31 does not press the fixing sleeve 21 against the nip formation member 26 as illustrated in FIG. 6A, an outer surface portion 26B of the nip formation member 26 which faces the nip side inner circumferential surface of the fixing sleeve 21 is curved like a bow to have a convex shape toward the fixing sleeve 21 in which the nip formation member 26 is disposed gradually closer to the nip side inner circumferential surface of the fixing sleeve 21 from lateral end portions toward a center portion of the nip formation member 26 in the axial direction of the fixing sleeve 21.

The nip formation member 26 is attached to the core holder 28 after the outer surface portion 26B of the nip formation member 26 which faces the nip side inner circumferential surface of the fixing sleeve 21 is bent as illustrated in FIG. 6A or after the nip formation member 26 is molded into the bent shape as illustrated in FIG. 6A. By contrast, another face of the nip formation member 26 which faces the core holder 28, that is, an inner surface portion 26C, is planar in the axial direction of the fixing sleeve 21. Similarly, an inner surface portion 28C of the core holder 28 which faces the nip formation member 26 is also planar in the axial direction of the fixing sleeve 21.

With this configuration, when the pressing roller 31 applies pressure to the nip formation member 26 to press the fixing sleeve 21 against the nip formation member 26 as illustrated in FIG. 6B, the core holder 28 is bent by the pressure transmitted from the nip formation member 26 into a concave shape facing the nip formation member 26 in which the inner surface portion 28C of the core holder 28 which faces the nip formation member 26 is disposed gradually away from the nip side inner circumferential surface of the fixing sleeve 21 contacting the pressing roller 31 from the lateral end portions toward the center portion of the core holder 28 in the axial direction of the fixing sleeve 21.

However, the nip formation member 26 bent by default as described above, that is, the convex-shaped outer surface portion 26B of the nip formation member 26 which faces the pressing roller 31, effectively offsets bending of the core holder 28 in the axial direction of the fixing sleeve 21. Accordingly, the outer surface portion 26B of the nip formation member 26 which faces the pressing roller 31 becomes planar in the axial direction of the fixing sleeve 21. Consequently, the pressing roller 31 is pressed against the nip formation member 26 via the fixing sleeve 21 at the nip N with uniform pressure throughout the entire width of the fixing sleeve 21 in the axial direction of the fixing sleeve 21, and therefore heat and pressure are applied from the fixing sleeve 21 and the pressing roller 31 to the recording medium P passing through the nip N uniformly throughout the entire width of the fixing sleeve 21 in the axial direction of the fixing sleeve 21. As a result, the toner image T is fixed on the recording medium P properly throughout the entire width of the fixing sleeve 21 in the axial direction of the fixing sleeve 21, providing uniform gloss of the fixed toner image T.

When the pressing roller 31 is not pressed against the nip formation member 26 via the fixing sleeve 21, an amount of bending of the heater support 23, that is, a depth of the above-described concave of the sheet support portion 23Ba of the heater support 23, is set substantially equivalent to an amount of bending of the nip formation member 26, that is, a height of the above-described convex of the nip formation member 26. Accordingly, a total thickness of the elements provided inside the loop formed by the fixing sleeve 21, that is, the nip formation member 26, the core holder 28, the heater support 23, and the heat generation sheet 22*s*, is uniform in the axial direction of the fixing sleeve 21. Consequently, a gap between the inner circumferential surface of the fixing sleeve 21 and the elements provided inside the loop formed by the fixing sleeve 21 is uniform in the axial direction of the fixing sleeve 21. In other words, the heat generation sheet 22*s* contacts the fixing sleeve 21 uniformly in the axial direction of the fixing sleeve 21.

Alternatively, the heater support 23 may support the heat generation sheet 22*s* in such a manner that the heat generation sheet 22*s* protrudes from a virtual circumference of a perfect circle formed by the fixing sleeve 21 about the axis of the fixing sleeve 21 toward the opposite side from the nip formation member 26 via the axis of the fixing sleeve 21. Accordingly, the heat generation sheet 22*s* is disposed at a position at which the heat generation sheet 22*s* is pressed against the inner circumferential surface of the fixing sleeve 21 with greater pressure, improving heat transmission efficiency of the heat generation sheet 22*s* for transmitting heat to the fixing sleeve 21 uniformly in the axial direction of the fixing sleeve 21.

An axial hardness of the pressing roller 31 is lower than a hardness of the nip formation member 26. Accordingly, when the pressing roller 31 is pressed against the nip formation member 26 via the fixing sleeve 21, the pressing roller 31 is deformed, and the heat generation sheet 22*s* contacts the fixing sleeve 21 more stably over time.

Figure 7:
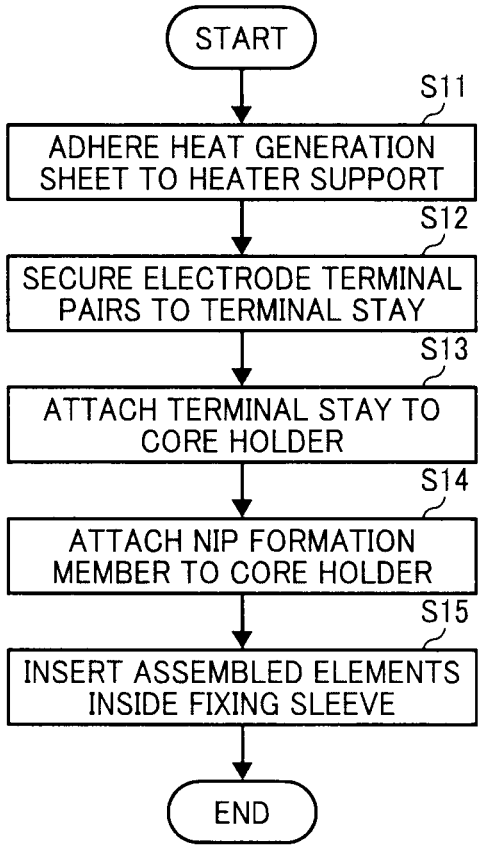
FIG. 7 is a flowchart illustrating steps of a method for assembling the fixing device shown in FIG. 6A.

Referring to FIGS. 5 and 7, the following describes a method for assembling the elements provided inside the loop formed by the fixing sleeve 21. FIG. 7 is a flowchart illustrating steps of the method for assembling those elements.

In step S11, the heat generation sheet 22*s* of the laminated heater 22 is adhered to the arc-shaped sheet support portion 23Ba on the outer circumferential surface 23B of the heater support 23 with an adhesive having a low heat conductivity that prevents heat transmission from the heat generation sheet 22*s* to the heater support 23.

It is to be noted that all of the plurality of electrode terminal pairs 22*e*, which are connected the electrode layers 22*c* depicted in FIG. 4, are provided at one edge of the heat generation sheet 22*s* in the circumferential direction of the fixing sleeve 21.

When the heat generation sheet 22*s* is adhered to the sheet support portion 23Ba of the heater support 23 in step S11, the electrode terminal pairs 22*e* extend along and beyond the outer circumference surface 23B of the heater support 23 in such a manner that the electrode terminal pairs 22*e* protrude from one edge of the heater support 23 in a circumferential direction of the heater support 23.

In step S12, the protruded electrode terminal pairs 22*e* are folded along the edge of the heater support 23 to direct the electrode terminal pairs 22*e* toward the axis of the fixing sleeve 21, and then the electrode terminal pairs 22*e* are secured to the terminal stay 24 in a state in which the electrode terminal pairs 22*e* are connected to the power supply wire 25.

In step S13, the terminal stay 24 is attached to the core holder 28 in such a manner that the terminal stay 24 mounted with the electrode terminal pairs 22*e* is placed inside the second concave portion of the core holder 28 disposed back-to-back to the first concave portion of the core holder 28 which faces the nip N. Then, the heater support 23 is attached to the core holder 28 in such a manner that the planar inner surface portion 23C of the heater support 23 disposed back-to-back to the sheet support portion 23Ba adhered to the heat generation sheet 22*s* contacts the outer surface portion 28B of the core holder 28 throughout the entire width of the heater support 23 in the axial direction of the fixing sleeve 21.

In step S14, the nip formation member 26 is attached to the core holder 28 in such a manner that the nip formation member 26 is placed inside the first concave portion of the core holder 28, completing the steps of assembling the elements to be provided inside the loop formed by the fixing sleeve 21.

Finally, in step S15, the assembled elements are inserted into the loop formed by the fixing sleeve 21 so that the elements are disposed inside the fixing sleeve 21 as illustrated in FIG. 5, thus completing assembly of the fixing sleeve 21 and the elements inside the fixing sleeve 21.

Alternatively, the heat generation sheet 22*s* need not be adhered to the heater support 23 with the adhesive. In this case, the electrode terminal pairs 22*e* extending from one edge of the heater support 23 disposed back-to-back to another edge of the heater support 23 provided near the nip N in the circumferential direction of the fixing sleeve 21 may be secured to the terminal stay 24 with screws. The fixing sleeve 21 rotating in the rotation direction R1 pulls or stretches the heat generation sheet 22*s* toward the nip N while at the same time the heat generation sheet 22*s* is held by the electrode terminal pairs 22*e* mounted on the terminal stay 24. Accordingly, the heat generation sheet 22*s* contacts the fixing sleeve 21 stably in a state in which the heat generation sheet 22*s* is sandwiched between the heater support 23 and the fixing sleeve 21, thus heating the fixing sleeve 21 effectively.

However, the heat generation sheet 22*s* not adhered to the heater support 23 has a drawback in that the heat generation sheet 22*s* is levitated from the heater support 23 and therefore can be shifted from its proper position. For example, when the fixing sleeve 21 rotates backward for removal of a jammed recording medium P, the backward rotation of the fixing sleeve 21 levitates the heat generation sheet 22*s* from the heater support 23, moving the heat generation sheet 22*s* from its proper position. The movement of the heat generation sheet 22*s* may twist or deform the electrode terminal pairs 22*e*, resulting in breakage of the electrode terminal pairs 22*e*. Therefore, preferably, the heat generation sheet 22*s* is attached to the heater support 23 by adhesion to prevent deviation of the heat generation sheet 22*s* from its proper position.

At the same time, if the entire heat generation sheet 22*s* is adhered to the heater support 23, heat is transmitted from the entire heat generation sheet 22*s* to the heater support 23, decreasing heat transmission efficiency of the heat generation sheet 22*s* for transmitting heat to the fixing sleeve 21. To address this problem, it is preferable that the heat generation sheet 22*s* is adhered to the heater support 23 only at the lateral end portions of the heat generation sheet 22*s* in the axial direction of the fixing sleeve 21 corresponding to non-conveyance regions on the fixing sleeve 21 over which the recording medium P is not conveyed, but not at the center portion of the heat generation sheet 22*s* in the axial direction of the fixing sleeve 21 corresponding to a conveyance region on the fixing sleeve 21 over which the recording medium P is conveyed. Accordingly, the heat generation sheet 22*s* does not deviate from the proper position on the heater support 23, and at the same time the center portion of the heat generation sheet 22*s* in the axial direction of the fixing sleeve 21 corresponding to the conveyance region on the fixing sleeve 21 over which the maximum recording medium P available in the fixing device 20 is conveyed is not adhered to the heater support 23 and therefore is levitated from the heater support 23. Consequently, heat is not transmitted from the center portion of the heat generation sheet 22*s* to the heater support 23. In other words, heat generated in the center portion of the heat generation sheet 22*s* can be used to heat the fixing sleeve 21 effectively.

The heat generation sheet 22*s* may be adhered to the heater support 23 either with a liquid adhesive for coating or a tape adhesive (e.g., a double-faced adhesive tape), which provides adhesion on both sides thereof and is made of a heat-resistant acryl or silicon material. Accordingly, the laminated heater 22 (e.g., the heat generation sheet 22*s*) is adhered to the heater support 23 easily. Further, if the laminated heater 22 malfunctions, it can be replaced easily by peeling off the double-faced adhesive tape, facilitating maintenance.

It is to be noted that, if the heat generation sheet 22*s* and the heater support 23 merely sandwich the double-faced adhesive tape, the lateral end portions of the heat generation sheet 22*s* in the axial direction of the fixing sleeve 21, which are adhered to the heater support 23, are lifted by a thickness of the double-faced adhesive tape. Accordingly, the center portion of the heat generation sheet 22*s* in the axial direction of the fixing sleeve 21, which is not adhered to the heater support 23, does not contact the fixing sleeve 21 uniformly, decreasing heating efficiency for heating the fixing sleeve 21 and varying temperature distribution of the fixing sleeve 21 in the axial direction of the fixing sleeve 21.

Figure 8:
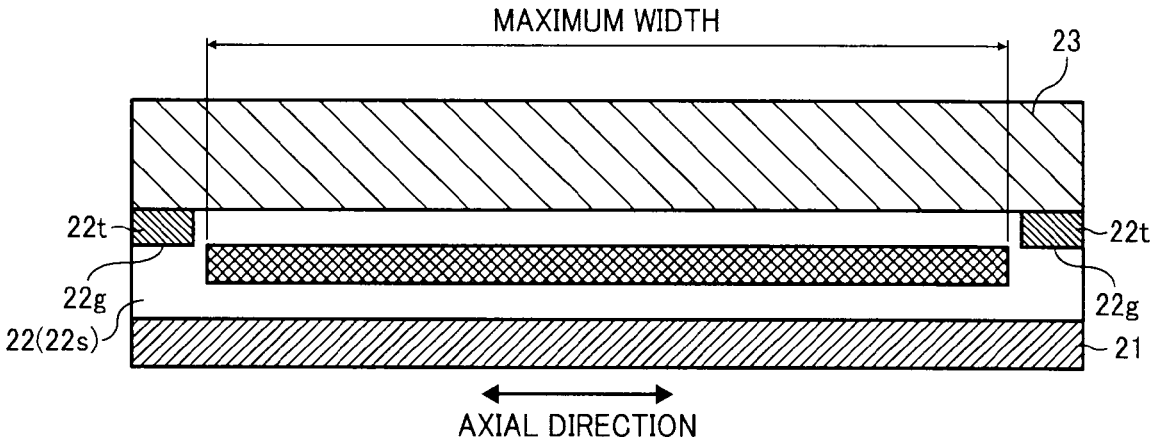
FIG. 8 is a horizontal sectional view of the laminated heater shown in FIG. 4, and a fixing sleeve and a heater support included in the fixing device shown in FIG. 5 illustrating edge grooves included in the laminated heater.

To address this problem, the lateral end portions of the heat generation sheet 22*s* in the axial direction of the fixing sleeve 21, which are adhered to the heater support 23 with the double-faced adhesive tape, can have a thickness decreased by the thickness of the double-faced adhesive tape as illustrated in FIG. 8. FIG. 8 is a horizontal sectional view of the heater support 23, the laminated heater 22, and the fixing sleeve 21. As illustrated in FIG. 8, the laminated heater 22 further includes edge grooves 22*g* and double-faced adhesive tapes 22*t*.

The edge grooves 22*g* are provided at lateral edges, which correspond to the non-conveyance regions on the fixing sleeve 21 over which the recording medium P is not conveyed, of the heat generation sheet 22*s* in the axial direction of the fixing sleeve 21, respectively, on a surface of the base layer 22*a* (depicted in FIG. 4) of the heat generation sheet 22*s* that faces the heater support 23, and extend in the circumferential direction of the fixing sleeve 21. Each of the edge grooves 22*g* has a depth equivalent to the thickness (e.g., about 0.1 mm) of the double-faced adhesive tape 22*t*. The double-faced adhesive tapes 22*t* are adhered to the edge grooves 22*g* of the heat generation sheet 22*s*, respectively, and then adhered to the heater support 23. In other words, the heat generation sheet 22*s* is adhered to the heater support 23 at predetermined positions on the heater support 23 via the double-faced adhesive tapes 22*t*. Accordingly, when the heat generation sheet 22*s* is adhered to the heater support 23, a surface of the heat generation sheet 22*s* which faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction of the fixing sleeve 21.

Figure 9:
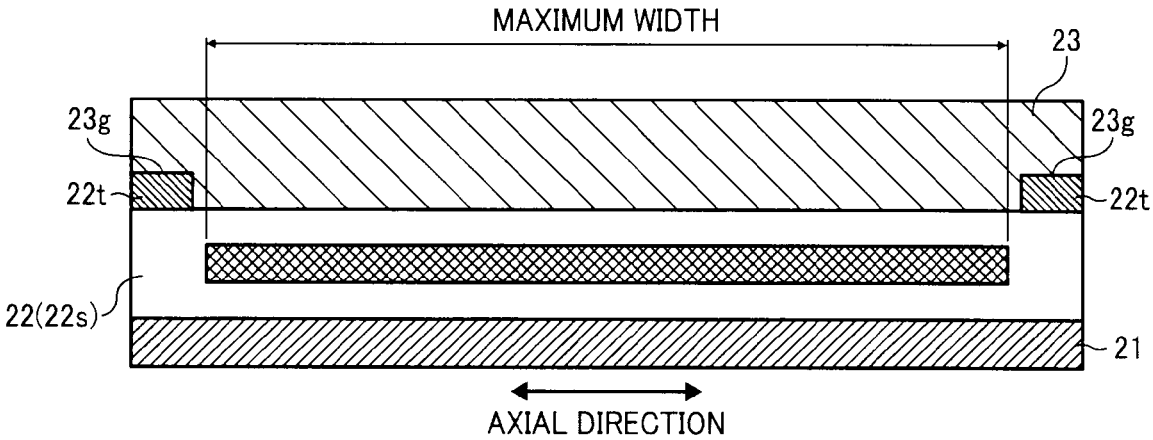
FIG. 9 is a horizontal sectional view of the laminated heater shown in FIG. 4, and a fixing sleeve and a heater support included in the fixing device shown in FIG. 5 illustrating edge grooves included in the heater support.

Alternatively, edge grooves may be provided in the heater support 23 instead of in the heat generation sheet 22*s* as illustrated in FIG. 9. FIG. 9 is a horizontal sectional view of the heater support 23, the laminated heater 22, and the fixing sleeve 21. As illustrated in FIG. 9, the heater support 23 includes edge grooves 23*g*.

The edge grooves 23*g* are provided at lateral edges of the heater support 23 in the axial direction of the fixing sleeve 21, which correspond to the non-conveyance regions on the fixing sleeve 21 over which the recording medium P is not conveyed, on a surface of the heater support 23 which faces the heat generation sheet 22*s*, and extend in the circumferential direction of the fixing sleeve 21. Each of the edge grooves 23*g* has a depth equivalent to the thickness of the double-faced adhesive tape 22*t*. The double-faced adhesive tapes 22*t* are adhered to the edge grooves 23*g* of the heater support 23, respectively, and then the heat generation sheet 22*s* is adhered to the heater support 23 via the double-faced adhesive tapes 22*t*. Accordingly, when the heat generation sheet 22*s* is adhered to the heater support 23, the surface of the heat generation sheet 22*s* which faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction of the fixing sleeve 21.

Referring to FIGS. 1 and 5, the following describes operation of the fixing device 20 having the above-described structure.

When the image forming apparatus 1 receives an output signal, for example, when the image forming apparatus 1 receives a print request specified by a user by using a control panel or a print request sent from an external device, such as a client computer, the pressure apply-release mechanism applies pressure to the pressing roller 31 to cause the pressing roller 31 to press the fixing sleeve 21 against the nip formation member 26 to form the nip N between the pressing roller 31 and the fixing sleeve 21.

Thereafter, a driver drives and rotates the pressing roller 31 clockwise in FIG. 5 in the rotation direction R2. Accordingly, the fixing sleeve 21 rotates counterclockwise in FIG. 5 in the rotation direction R1 in accordance with rotation of the pressing roller 31. The heat generation sheet 22*s* of the laminated heater 22 supported by the heater support 23 contacts the inner circumferential surface of the fixing sleeve 21 with predetermined pressure or greater throughout the entire width of the heat generation sheet 22*s* in the axial direction of the fixing sleeve 21 so that the fixing sleeve 21 slides over the heat generation sheet 22*s*.

Simultaneously, an external power source or an internal capacitor supplies power to the laminated heater 22 via the power supply wire 25 to cause the heat generation sheet 22*s* to generate heat. The heat generated by the heat generation sheet 22*s* is transmitted effectively to the fixing sleeve 21 contacting the heat generation sheet 22*s*, so that the fixing sleeve 21 is heated quickly. Alternatively, heating of the fixing sleeve 21 by the laminated heater 22 may not start simultaneously with driving of the pressing roller 31 by the driver. In other words, the laminated heater 22 may start heating the fixing sleeve 21 at a time different from a time at which the driver starts driving the pressing roller 31.

A temperature detector is provided at a position upstream from the nip N in the rotation direction R1 of the fixing sleeve 21. For example, the temperature detector may be provided outside the loop formed by the fixing sleeve 21 to face the outer circumferential surface of the fixing sleeve 21 with or without contacting the fixing sleeve 21. Alternatively, the temperature detector may be provided inside the loop formed by the fixing sleeve 21. The temperature detector detects a temperature of the fixing sleeve 21 so that heat generation of the laminated heater 22 is controlled based on a detection result provided by the temperature detector to heat the nip N to a predetermined fixing temperature. When the nip N is heated to the predetermined fixing temperature, the fixing temperature is maintained, and a recording medium P is conveyed to the nip N.

In the fixing device 20 according to this exemplary embodiment, the fixing sleeve 21 and the laminated heater 22 have a small heat capacity, shortening a warm-up time and a first print time of the fixing device 20 while saving energy. Further, the heat generation sheet 22*s* is a resin sheet. Accordingly, even when rotation and vibration of the pressing roller 31 applies stress to the heat generation sheet 22*s* repeatedly, and therefore bends the heat generation sheet 22*s* repeatedly, the heat generation sheet 22*s* is not broken due to wear, resulting in a longer operation of the fixing device 20. Moreover, the heat generation sheet 22*s* heats the fixing sleeve 21 uniformly throughout the entire width of the fixing sleeve 21 in the axial direction of the fixing sleeve 21. As a result, the toner image T is fixed on the recording medium P properly with uniform gloss in the axial direction of the fixing sleeve 21.

Usually, when the image forming apparatus 1 does not receive an output signal, the pressing roller 31 and the fixing sleeve 21 do not rotate and power is not supplied to the laminated heater 22 to save energy. However, in order to restart the fixing device 20 immediately after the image forming apparatus 1 receives an output signal, power can be supplied to the laminated heater 22 while the pressing roller 31 and the fixing sleeve 21 do not rotate. For example, power in an amount sufficient to keep the entire fixing sleeve 21 warm is supplied to the laminated heater 22.

On the other hand, in the fixing device 20 depicted in FIG. 5, which has the above-described structure, the heat generation sheet 22*s* may have the configuration in which the heat generation sheet 22*s* changes its heat generation area according to the size of the recording medium P passing through the nip N. For example, the surface of the base layer 22*a* (depicted in FIG. 4) of the heat generation sheet 22*s* is divided into a plurality of regions in the axial direction of the fixing sleeve 21, and the plurality of resistant heat generation layers 22*b* (depicted in FIG. 4) is provided in the plurality of regions, respectively, in such a manner that the plurality of resistant heat generation layers 22*b* can generate heat independently, so that the plurality of resistant heat generation layers 22*b* independently generating heat changes the heat generation area of the heat generation sheet 22*s*. Four variations of such configuration are described below in detail by referring to FIGS. 10A, 10B, 11, 12, and 13.

FIG. 10A is a plan view of a laminated heater 22U including a heat generation sheet 22*s*U as the first variation of the laminated heater 22 depicted in FIGS. 4 and 5. As illustrated in FIG. 10A, the heat generation sheet 22*s*U includes resistant heat generation layers 22*b*1 and 22*b*2. The electrode terminal pair 22*e* includes electrode terminals 22*e*1 and 22*e*2.

FIG. 10A illustrates the laminated heater 22U spread on a flat surface before the laminated heater 22U is adhered to the heater support 23 depicted in FIG. 5. A horizontal direction in FIG. 10A is a width direction of the laminated heater 22U parallel to the axial direction of the fixing sleeve 21. A vertical direction in FIG. 10A is a circumferential direction of the laminated heater 22U parallel to the circumferential direction of the fixing sleeve 21.

As illustrated in FIG. 10A, the heat generation sheet 22*s*U is divided into three regions on a surface of the heat generation sheet 22*s*U in the width direction of the heat generation sheet 22*s*U parallel to the axial direction of the fixing sleeve 21. Further, the heat generation sheet 22*s*U is divided into two regions on the surface of the heat generation sheet 22*s*U in the circumferential direction of the heat generation sheet 22*s*U and the fixing sleeve 21. Thus, in total, the heat generation sheet 22*s*U is divided into six regions as shown in FIG. 10B. FIG. 10B is a lookup table of a matrix with two rows in the circumferential direction of the fixing sleeve 21 and three columns in the axial direction of the fixing sleeve 21, referred to as a 2-by-3 array of 6 elements corresponding to the six regions. The resistant heat generation layer 22*b*1 having a predetermined width and length is provided in the element (1, 2) corresponding to the region provided at a lower center portion of the heat generation sheet 22*s*U in FIG. 10A in the axial direction of the fixing sleeve 21. The resistant heat generation layers 22*b*2 having a predetermined width and length are provided in the elements (2, 1) and (2, 3) corresponding to the regions provided at upper lateral end portions of the heat generation sheet 22*s*U in FIG. 10A in the axial direction of the fixing sleeve 21, respectively.

The electrode layers 22*c* connected to the resistant heat generation layer 22*b*1 are provided in the elements (1, 1) and (1, 3) corresponding to the regions provided at lower lateral end portions of the heat generation sheet 22*s*U in FIG. 10A in the axial direction of the fixing sleeve 21, respectively. Each of the electrode layers 22*c* is connected to the electrode terminal 22*e*1 that protrudes from one edge, that is, a lower edge in FIG. 10A, of the heat generation sheet 22*s*U, foaming a first heat generation circuit.

The electrode layer 22*c* connected to and sandwiched between the two resistant heat generation layers 22*b*2 is provided in the element (2, 2) corresponding to the region provided at an upper center portion of the heat generation sheet 22*s*U in FIG. 10A in the axial direction of the fixing sleeve 21. Each of the two resistant heat generation layers 22*b*2 is connected to the electrode layer 22*c* that extends to the lower edge of the heat generation sheet 22*s*U in FIG. 10A in the circumferential direction of the heat generation sheet 22*s*U. Each of the electrode layers 22*c* is connected to the electrode terminal 22*e*2 that protrudes from the lower edge of the heat generation sheet 22*s*U, foaming a second heat generation circuit.

The insulation layer 22*d* is provided between the first heat generation circuit and the second heat generation circuit to prevent a short circuit of the first heat generation circuit and the second heat generation circuit. Further, another insulation layer 22*d* is provided at edges of the heat generation sheet 22*s*U to insulate the heat generation sheet 22*s*U from the outside thereof.

In the laminated heater 22U having the above-described configuration, when the electrode terminals 22*e*1 supply power to the heat generation sheet 22*s*U, internal resistance of the resistant heat generation layer 22*b*1 generates Joule heat. By contrast, the electrode layers 22*c* do not generate heat due to their low resistance. Accordingly, only the region of the heat generation sheet 22*s*U shown by the element (1, 2) generates heat to heat a center portion of the fixing sleeve 21 in the axial direction of the fixing sleeve 21.

By contrast, when the electrode terminals 22*e*2 supply power to the heat generation sheet 22*s*U, internal resistance of the resistant heat generation layers 22*b*2 generates Joule heat. However, the electrode layers 22*c* do not generate heat due to their low resistance. Accordingly, only the regions of the heat generation sheet 22*s*U shown by the elements (2, 1) and (2, 3), respectively, generate heat to heat the lateral end portions of the fixing sleeve 21 in the axial direction of the fixing sleeve 21.

When a small size recording medium P having a small width passes through the fixing device 20, power is supplied to the electrode terminals 22*e*1 only to heat only the center portion of the heat generation sheet 22*s*U in the axial direction of the fixing sleeve 21. By contrast, when a large size recording medium P having a large width passes through the fixing device 20, power is supplied to both the electrode terminals 22*e*1 and 22*e*2 to heat the heat generation sheet 22*s*U throughout the entire width thereof in the axial direction of the fixing sleeve 21. Thus, the fixing device 20 provides desired fixing according to the width of the recording medium P with reduced energy consumption.

The controller 10 depicted in FIG. 1, that is, a central processing unit (CPU), controls an amount of heat generated by the laminated heater 22U according to the size of the recording medium P. Accordingly, even when the small size recording media P pass through the fixing device 20 continuously, the lateral end portions of the heat generation sheet 22*s*U corresponding to the non-conveyance regions of the fixing sleeve 21 over which the recording medium P is not conveyed, respectively, are not overheated, thus preventing stoppage of the fixing device 20 to protect the components of the fixing device 20 and decrease of productivity of the fixing device 20. The single, divided laminated heater 22U provides varied regions of the heat generation sheet 22*s*U, reducing temperature variation of the laminated heater 22U in the axial direction of the fixing sleeve 21 compared to a plurality of separate, laminated heaters.

Edges of each of the resistant heat generation layers 22*b*1 and 22*b*2 contacting the insulation layers 22*d* or the electrode layers 22*c* that have a relatively high heat conductivity generate a smaller amount of heat due to heat transmission from the resistant heat generation layers 22*b*1 and 22*b*2 to the insulation layers 22*d* or the electrode layers 22*c*. Accordingly, in the configuration illustrated in FIG. 10A in which a border between the center, resistant heat generation layer 22*b*1 and the adjacent electrode layer 22*c* and a border between the lateral, resistant heat generation layer 22*b*2 and the adjacent electrode layer 22*c* are provided on an identical face, when power is supplied to the electrode terminals 22*e*1 and 22*e*2, such borders have a decreased temperature, varying temperature distribution of the laminated heater 22U in the axial direction of the fixing sleeve 21. As a result, a faulty toner image is formed due to faulty fixing. To address this problem, other variations of the laminated heater 22 depicted in FIG. 4, that is, laminated heaters 22V and 22W illustrated in FIGS. 11 and 12 as the second and third variations of the laminated heater 22, respectively, can be used instead of the laminated heater 22U.

FIG. 11 is a plan view of the laminated heater 22V including a heat generation sheet 22*s*V as the second variation of the laminated heater 22 depicted in FIGS. 4 and 5. As illustrated in FIG. 11, the heat generation sheet 22*s*V includes a resistant heat generation layer 22*b*1V replacing the resistant heat generation layer 22*b*1 depicted in FIG. 10A.

The basic configuration of the laminated heater 22V is identical to that of the laminated heater 22U depicted in FIG. 10A, except that the resistant heat generation layer 22*b*1V has a longer width in the axial direction of the fixing sleeve 21. Specifically, the resistant heat generation layer 22*b*1V with the longer width causes the resistant heat generation layer 22*b*1V to partially overlap each of the resistant heat generation layers 22*b*2 in a width direction of the heat generation sheet 22*s*V parallel to the axial direction of the fixing sleeve 21, to form an overlap region V. Accordingly, when power is supplied to the electrode terminals 22*e*1 and 22*e*2, temperature decrease is prevented at a border between the resistant heat generation layer 22*b*1V and the adjacent electrode layer 22*c* and a border between the resistant heat generation layer 22*b*2 and the adjacent electrode layer 22*c*.

Figure 12:
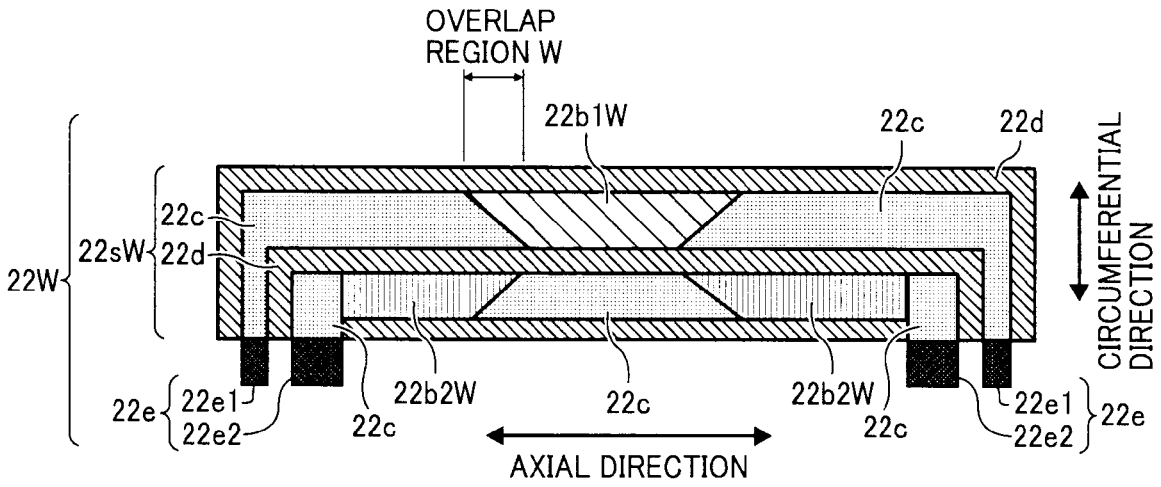
FIG. 12 is a plan view of a laminated heater as a third variation of the laminated heater shown in FIG. 4.

FIG. 12 is a plan view of the laminated heater 22W including a heat generation sheet 22*s*W as the third variation of the laminated heater 22 depicted in FIGS. 4 and 5. As illustrated in FIG. 12, the heat generation sheet 22*s*W includes resistant heat generation layers 22*b*1W and 22*b*2W replacing the resistant heat generation layers 22*b*1V and 22*b*2 depicted in FIG. 11, respectively.

The basic configuration of the laminated heater 22W is identical to that of the laminated heater 22V depicted in FIG. 11, except that the shape of the resistant heat generation layers 22*b*1W and 22*b*2W of the laminated heater 22W are different from that of the resistant heat generation layers 22*b*1V and 22*b*2 of the laminated heater 22V. Specifically, the resistant heat generation layer 22*b*1W partially overlaps each of the resistant heat generation layers 22*b*2W to form an overlap region W. In each overlap region W, a border between the resistant heat generation layer 22*b*1W and the adjacent electrode layer 22*c* is tapered with respect to a circumferential direction of the heat generation sheet 22*s*W in a direction opposite a direction in which a border between the resistant heat generation layer 22*b*2W and the adjacent electrode layer 22*c* is tapered with respect to the circumferential direction of the heat generation sheet 22*s*W. Thus, an amount of overlap of the resistant heat generation layer 22*b*1W and the resistant heat generation layer 22*b*2W is adjusted.

For example, with the configuration shown in FIG. 11, a width of the overlap region V in which the resistant heat generation layer 22*b*1V overlaps the resistant heat generation layer 22*b*2 in the width direction of the heat generation sheet 22*s*V parallel to the axial direction of the fixing sleeve 21, is unchanged. Accordingly, if the width of the overlap region V varies, an amount of heat generated by the heat generation sheet 22*s*V varies. To address this problem, with the configuration shown in FIG. 12, the width of the overlap region W in the axial direction of the fixing sleeve 21 changes in the circumferential direction of the heat generation sheet 22*s*W. For example, the width of the overlap region W of the resistant heat generation layer 22*b*1W and the width of the overlap region W of the resistant heat generation layer 22*b*2W decrease at a predetermined rate in a downward direction in FIG. 12. Accordingly, heat generation distribution is adjusted to reduce adverse effects of production errors of the laminated heater 22W. As a result, the laminated heater 22W provides uniform temperature throughout the axial direction of the fixing sleeve 21.

Referring to FIG. 10A, the following describes a method for manufacturing the heat generation sheet 22*s*U which is also used for manufacturing the heat generation sheet 22*s*V depicted in FIG. 11 and the heat generation sheet 22*s*W depicted in FIG. 12.

In the laminated heater 22U depicted in FIG. 10A, only portions on the surface of the base layer 22*a* depicted in FIG. 4 on which the resistant heat generation layers 22*b*1 and 22*b*2 are to be provided are exposed and coated to form the resistant heat generation layers 22*b*1 and 22*b*2. Then, only portions on the surface of the base layer 22*a* on which the insulation layers 22*d* are to be provided are exposed and coated to form the insulation layers 22*d* formed of heat-resistant resin. Thereafter, only portions on the surface of the base layer 22*a* on which the electrode layers 22*c* are to be provided are exposed and coated with a conductive paste to form the electrode layers 22*c*. In other words, the resistant heat generation layers 22*b*1 and 22*b*2 having an arbitrary shape are formed by adjusting exposure of the portions on the surface of the base layer 22*a* on which the resistant heat generation layers 22*b*1 and 22*b*2 are to be provided. Similarly, the resistant heat generation layers 22*b*1V and 22*b*2 of the laminated heater 22V depicted in FIG. 11 and the resistant heat generation layers 22*b*1W and 22*b*2W of the laminated heater 22W depicted in FIG. 12 can be formed.

Figure 13:
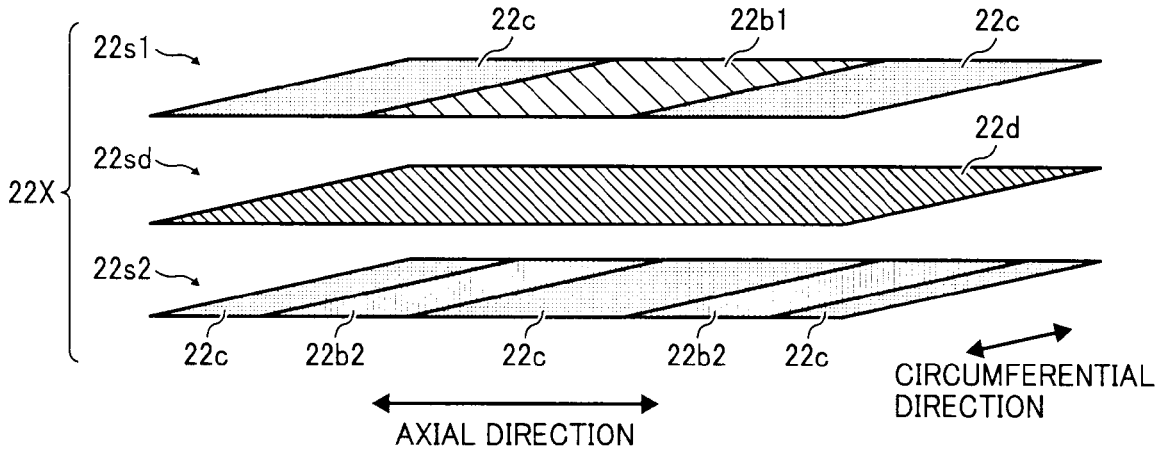
FIG. 13 is an exploded perspective view of a laminated heater as a fourth variation of the laminated heater shown in FIG. 4.

Alternatively, the laminated heater (e.g., the laminated heater 22, 22U, 22V, or 22W) may include a plurality of layered heat generation sheets in each of which one or more resistant heat generation layers are provided on an arbitrary portion on the surface of the base layer 22*a* in such a manner that the resistant heat generation layers generate heat independently from each other. FIG. 13 illustrates a laminated heater 22X including a plurality of heat generation sheets as the fourth variation of the laminated heater 22 depicted in FIGS. 4 and 5.

FIG. 13 is an exploded perspective view of the laminated heater 22X. As illustrated in FIG. 13, the laminated heater 22X is constructed of a first heat generation sheet 22*s*1 that includes the resistant heat generation layer 22*b*1 and the electrode layers 22*c*; an insulation sheet 22*sd* that includes the insulation layer 22*d*; and a second heat generation sheet 22*s*2 that includes the resistant heat generation layers 22*b*2 and the electrode layers 22*c*. The first heat generation sheet 22*s*1 is provided on the insulation sheet 22*sd* provided on the second heat generation sheet 22*s*2.

Specifically, the first heat generation sheet 22*s*1 is divided into three regions on a surface of the first heat generation sheet 22*s*1 in a width direction of the first heat generation sheet 22*s*1 parallel to the axial direction of the fixing sleeve 21. The resistant heat generation layer 22*b*1 is provided in a center region on the surface of the first heat generation sheet 22*s*1. The electrode layers 22*c*, which are connected to the adjacent resistant heat generation layer 22*b*1, are provided in lateral end regions on the surface of the first heat generation sheet 22*s*1, respectively.

The second heat generation sheet 22*s*2 is divided into five regions on a surface of the second heat generation sheet 22*s*2 in a width direction of the second heat generation sheet 22*s*2 parallel to the axial direction of the fixing sleeve 21. The resistant heat generation layers 22*b*2 are provided in the second and fourth regions from left to right in FIG. 13 in the axial direction of the fixing sleeve 21, respectively. The electrode layers 22*c*, which are connected to the adjacent resistant heat generation layers 22*b*2, are provided in the remaining first, third, and fifth regions from left to right in FIG. 13 in the axial direction of the fixing sleeve 21, respectively.

The first heat generation sheet 22*s*1 is provided on the second heat generation sheet 22*s*2 via the insulation sheet 22*sd* in such a manner that the first heat generation sheet 22*s*1 and the second heat generation sheet 22*s*2 sandwich the insulation sheet 22*sd*. Thus, an independent first heat generation circuit is provided in the first heat generation sheet 22*s*1, and another independent second heat generation circuit is provided in the second heat generation sheet 22*s*2.

With this configuration, when power is supplied to the first heat generation circuit, internal resistance of the resistant heat generation layer 22*b*1 generates Joule heat, and only the center region on the surface of the first heat generation sheet 22*s*1 in the width direction of the first heat generation sheet 22*s*1 generates heat to heat the center portion of the fixing sleeve 21 in the axial direction of the fixing sleeve 21. By contrast, when power is supplied to the second heat generation circuit, internal resistance of the resistant heat generation layers 22*b*2 generates Joule heat, and only the lateral end regions on the surface of the second heat generation sheet 22*s*2 in the width direction of the second heat generation sheet 22*s*2 generate heat to heat the lateral end portions of the fixing sleeve 21 in the axial direction of the fixing sleeve 21.

If the laminated heater 22X is divided in a circumferential direction of the laminated heater 22X also as in the laminated heaters 22U, 22V, and 22W depicted in FIGS. 10A, 11, and 12, respectively, the laminated heater 22X need to have an increased area to provide a desired heat generation amount, and therefore is not installed inside the small fixing sleeve 21 having a small diameter. To address this problem, the laminated heater 22X includes the plurality of heat generation sheets layered in a thickness direction, that is, the second heat generation sheet 22*s*2 and the first heat generation sheet 22*s*1 provided on the second heat generation sheet 22*s*2 in such a manner that the resistant heat generation layer 22*b*1 of the first heat generation sheet 22*s*1 is shifted from the resistant heat generation layers 22*b*2 of the second heat generation sheet 22*s*2 in the width direction of the laminated heater 22X as illustrated in FIG. 13. Accordingly, the laminated heater 22X provides varied heat generation distribution in the axial direction of the fixing sleeve 21 adjustable according to the size of the recording medium P, like the laminated heaters 22U, 22V, and 22W depicted in FIGS. 10A, 11, and 12, respectively, providing an increased output of heat while saving space and downsizing the fixing device 20.

Figure 14:
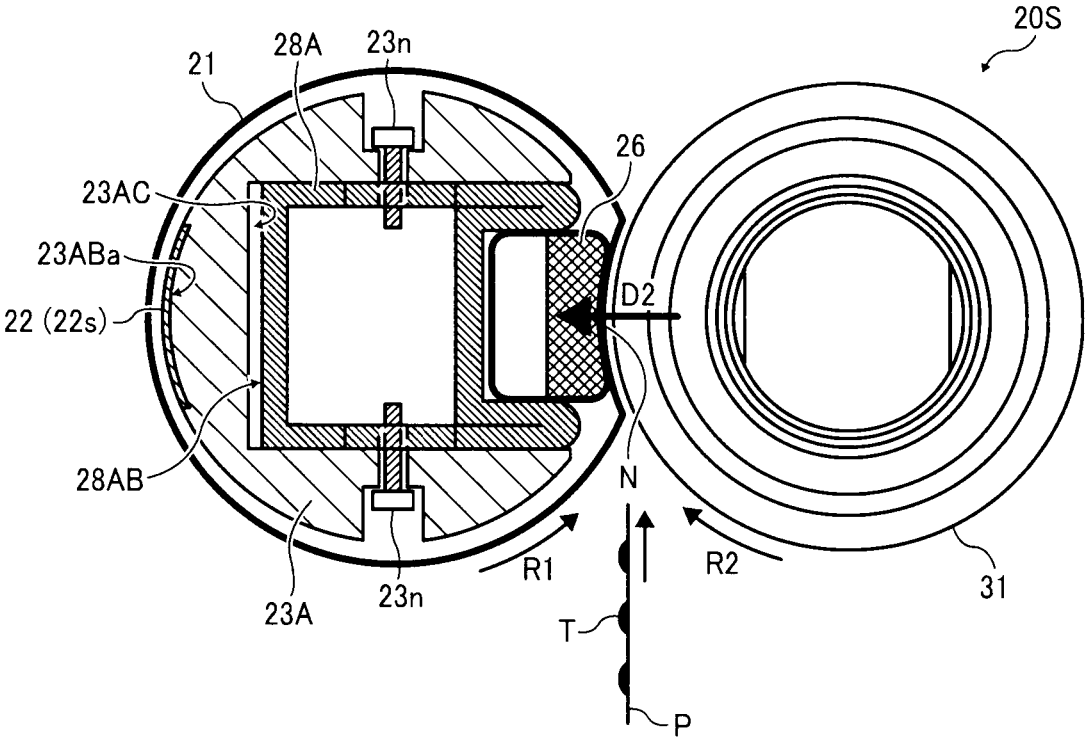
FIG. 14 is a vertical sectional view of a fixing device according to another exemplary embodiment of the present invention.

Referring to FIG. 14, the following describes a fixing device 20S according to a second illustrative embodiment of the present invention. FIG. 14 is a vertical sectional view of the fixing device 20S. As illustrated in FIG. 14, the fixing device 20S includes the fixing sleeve 21 formed into a loop, the laminated heater 22, a heater support 23A, the nip formation member 26, and a core holder 28A, which are provided inside the loop formed by the fixing sleeve 21, and the pressing roller 31 provided outside the loop formed by the fixing sleeve 21. The fixing device 20S further includes the pressure apply-release mechanism described above, which applies pressure to the pressing roller 31 to press the pressing roller 31 against the nip formation member 26 via the fixing sleeve 21 and releases the pressure to separate the pressing roller 31 from the fixing sleeve 21. FIG. 14 does not illustrate the terminal stay 24 and the power supply wire 25. In other words, the structure of the fixing device 20S is equivalent to that of the fixing device 20 depicted in FIG. 5 except that the heater support 23A and the core holder 28A replace the heater support 23 and the core holder 28 depicted in FIG. 5, respectively.

The heater support 23A supports the heat generation sheet 22*s* of the laminated heater 22 in such a manner that the heat generation sheet 22*s* contacts the inner circumferential surface of the fixing sleeve 21, and is made of the materials used in the heater support 23.

The heater support 23A includes a sheet support portion 23ABa on an outer circumferential surface thereof, which has an arc shape of a predetermined length in a circumferential direction of the heater support 23A along the inner circumferential surface of the fixing sleeve 21 having a circular shape in cross-section. The heater support 23A supports the heat generation sheet 22*s* at a position opposite the nip formation member 26 via the axis of the fixing sleeve 21. The heater support 23A is molded into a C-like shape in cross-section and has a predetermined width in a longitudinal direction of the heater support 23A parallel to the axial direction of the fixing sleeve 21. The heater support 23A houses the core holder 28A inside the C-like shape in cross-section thereof, and is attached to the core holder 28A.

For example, the heater support 23A is secured to the core holder 28A with screws 23*n* at an upper position and an opposed lower position on the heater support 23A in a vertical direction in FIG. 14, perpendicular to the pressure application direction D2 in which the pressing roller 31 applies pressure to the nip formation member 26. Specifically, a shaft of the screw 23*n* penetrates a through-hole provided in the heater support 23A and engages threads of a through-hole provided in the core holder 28A. Although the number of through-holes is not particularly limited, preferably, at least three through-holes are provided in the core holder 28A at a center and both lateral ends of the core holder 28A in a longitudinal direction of the core holder 28A parallel to the axial direction of the fixing sleeve 21.

An inner surface portion 23AC of the heater support 23A, that is, an interior wall of the C-like shaped heater support 23A, provided opposite the sheet support portion 23ABa on an outer circumferential surface of the heater support 23A which supports the heat generation sheet 22*s* is a planar straight surface extending in the axial direction of the fixing sleeve 21, which contacts an outer surface portion 28AB of the core holder 28A throughout the entire longitudinal direction of the heater support 23A.

The core holder 28A is a rectangular rigid member in cross-section made of sheet metal and having a predetermined width in the longitudinal direction thereof parallel to the axial direction of the fixing sleeve 21. The core holder 28A is disposed at substantially a center of the loop formed by the fixing sleeve 21 in such a manner that the lateral ends of the core holder 28A in the axial direction of the fixing sleeve 21 are supported by a frame of the fixing device 20S. With this configuration, the core holder 28A supports the nip formation member 26 and the heater support 23A provided inside the loop formed by the fixing sleeve 21.

The laminated heater 22 of the fixing device 20S has the basic structure of the laminated heater 22 of the fixing device 20 shown in FIG. 5. However, in the fixing device 20S, the electrode terminal pairs 22*e* (depicted in FIG. 10A) extend from one edge of the heat generation sheet 22*s* to an outside of the fixing sleeve 21 in the axial direction of the fixing sleeve 21, and are connected to the power supply wire 25 depicted in FIG. 5 there to receive power from the power supply wire 25.

In the fixing device 20S with the above-described configuration, like the fixing device 20 depicted in FIG. 5, the nip formation member 26, the core holder 28A, the heater support 23A, and the laminated heater 22 including the heat generation sheet 22*s* are aligned, in this order, in the pressure application direction D2 in which the pressing roller 31 applies pressure to the nip formation member 26 via the fixing sleeve 21, thus providing effects equivalent to the above-described effects of the fixing device 20 according to the first illustrative embodiment.

Referring to FIGS. 5, 6A, 6B, and 14, a description is provided of the effects provided by the fixing devices 20 and 20S.

In the fixing device (e.g., the fixing device 20 or 20S), the core holder (e.g., the core holder 28 or 28A) bent by pressure applied by the pressing member (e.g., the pressing roller 31) via the nip formation member (e.g., the nip formation member 26) presses the laminated heater (e.g., the laminated heater 22) against the inner circumferential surface of the fixing member (e.g., the fixing sleeve 21) via the heater support (e.g., the heater support 23 or 23A), improving heating efficiency of the laminated heater for heating the fixing member, which results in improved fixing performance of the fixing device for fixing a toner image on a recording medium. Further, since the laminated heater is pressed against the inner circumferential surface of the fixing member, the laminated heater is not levitated from the fixing member locally, and therefore does not generate excessive localized heat.

When the pressing member does not apply pressure to the heater support via the fixing member, the nip formation member, and the core holder, the heater support has the predetermined concave shape facing the heat generation sheet (e.g., the heat generation sheet 22*s*) of the laminated heater, as illustrated in FIG. 6A. Accordingly, when the pressing member applies pressure to the heater support, the core holder bent by the pressure presses the concave-shaped heater support into the planar shape toward the heat generation sheet in the axial direction of the fixing member. Consequently, the planar heater support presses the heat generation sheet against the inner circumferential surface of the fixing member in a state in which the heat generation sheet contacts the fixing member uniformly in the axial direction of the fixing member. In other words, the heat generation sheet transmits heat to the fixing member at a uniform efficiency at any positions on the heat generation sheet in the axial direction of the fixing member so as to heat the fixing member uniformly in the axial direction of the fixing member, improving fixing performance for fixing the toner image on the recording medium with uniform gloss throughout the entire width of the fixing member in the axial direction of the fixing member.

Moreover, when the fixing device is installed in the image forming apparatus (e.g., the image forming apparatus 1), the image faulting apparatus can shorten a warm-up time and a first print time with the improved fixing performance of the fixing device.

In the fixing devices 20 and 20S according to the above-described exemplary embodiments, the pressing roller 31 is used as a pressing member. Alternatively, a pressing belt or the like may be used as a pressing member to provide effects equivalent to the effects provided by the pressing roller 31. Further, the fixing sleeve 21 is used as a fixing member. Alternatively, an endless fixing belt or an endless fixing film may be used as a fixing member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

an endless belt-shaped fixing member to rotate in a predetermined direction of rotation, formed into a loop;

a nip formation member provided inside the loop formed by the fixing member;

a pressing member provided outside the loop formed by the fixing member to apply pressure to the nip formation member to press the fixing member against the nip formation member to form a nip between the pressing member and the fixing member through which the recording medium bearing the toner image passes;

a laminated heater facing an inner circumferential surface of the fixing member to heat the fixing member;

a heater support provided inside the loop formed by the fixing member between the laminated heater and the nip formation member, to support the laminated heater at a position opposite the nip formation member via an axis of the fixing member in a state in which the laminated heater is provided between the fixing member and the heater support; and a core holder provided inside the loop formed by the fixing member between the nip formation member and the heater support, and supported by a frame of the fixing device at lateral ends of the core holder in an axial direction of the fixing member, the core holder having a predetermined width in the axial direction of the fixing member to support the nip formation member and the heater support, wherein the core holder presses the laminated heater against the fixing member by the pressure from the pressing member.

2. The fixing device according to claim 1, wherein the laminated heater comprises a flexible heat generation sheet having a predetermined width in the axial direction of the fixing member and a predetermined length in a circumferential direction of the fixing member, the heat generation sheet comprising:

an insulating base layer;

a resistant heat generation layer provided on the base layer to generate heat and including conductive particles dispersed in a heat-resistant resin; and an electrode layer provided on the base layer to supply power to the resistant heat generation layer.

3. The fixing device according to claim 1, wherein the heater support comprises a support portion provided on an outer surface thereof to contact and support the laminated heater, and wherein, in a state in which the pressing member does not apply pressure to the nip formation member, the support portion of the heater support has a concave shape facing the laminated heater to form a gradually increasing gap between the laminated heater contacted by the support portion of the heater support and the fixing member extending from lateral ends toward a center of the heater support in the axial direction of the fixing member.

4. The fixing device according to claim 3, wherein the nip formation member comprises an outer surface portion provided on an outer surface thereof that faces the nip via the fixing member, and wherein, in a state in which the pressing member does not apply pressure to the nip formation member, the outer surface portion of the nip formation member has a convex shape facing the nip via the fixing member to form a gradually decreasing gap between the nip formation member and the fixing member extending from lateral ends toward a center of the nip formation member in the axial direction of the fixing member.

5. The fixing device according to claim 4, wherein a depth of the concave-shaped support portion of the heater support is substantially equivalent to a height of the convex-shaped outer surface portion of the nip formation member.

6. The fixing device according to claim 5, wherein, in a state in which the pressing member applies pressure to the nip formation member, the convex-shaped outer surface portion of the nip formation member is flattened by the pressing member to cause the nip formation member to contact the fixing member uniformly in the axial direction of the fixing member, and the nip formation member transmits the pressure from the pressing member to the core holder to bend the core holder by an amount equivalent to the height of the convex-shaped outer surface portion of the nip formation member.

7. The fixing device according to claim 6, wherein, in a state in which the pressing member applies pressure to the nip formation member, the bent core holder further transmits the pressure from the pressing member to the heater support to flatten the concave-shaped support portion of the heater support by offsetting the depth of the concave-shaped support portion of the heater support with the height of the convex-shaped outer surface portion of the nip formation member.

8. The fixing device according to claim 1, wherein the laminated heater protrudes from a virtual circumference of a perfect circle formed by the fixing member about the axis of the fixing member toward opposite of the nip formation member via the axis of the fixing member.

9. The fixing device according to claim 1, wherein the pressing member has an axial hardness smaller than a hardness of the nip formation member.

10. The fixing device according to claim 1, wherein the heater support has a C-like shape in cross-section and the core holder has a rectangular shape in cross-section, and wherein the rectangular core holder is secured to interior walls of the C-like shaped heater support.

11. The fixing device according to claim 10, wherein the core holder is secured to the heater support with screws.

12. An image forming apparatus comprising the fixing device according to claim 1.

13. A fixing device for fixing a toner image on a recording medium, comprising:

an endless belt-shaped fixing member to rotate in a predetermined direction of rotation, formed into a loop;

a nip formation member provided inside the loop formed by the fixing member;

a pressing member provided outside the loop formed by the fixing member to apply pressure to the nip formation member to press the fixing member against the nip formation member to form a nip between the pressing member and the fixing member through which the recording medium bearing the toner image passes;

a laminated heater facing an inner circumferential surface of the fixing member to heat the fixing member;

a heater support provided inside the loop formed by the fixing member between the laminated heater and the nip formation member, to support the laminated heater at a position opposite the nip formation member via an axis of the fixing member in a state in which the laminated heater is provided between the fixing member and the heater support; and a core holder provided inside the loop formed by the fixing member between the nip formation member and the heater support, and supported by a frame of the fixing device at lateral ends of the core holder in an axial direction of the fixing member, the core holder having a predetermined width in the axial direction of the fixing member to support the nip formation member and the heater support, wherein the heater support comprises a support portion provided on an outer surface thereof to contact and support the laminated heater, and wherein, in a state in which the pressing member does not apply pressure to the nip formation member, the support portion of the heater support has a concave shape facing the laminated heater to form a gradually increasing gap between the laminated heater contacted by the support portion of the heater support and the fixing member extending from lateral ends toward a center of the heater support in the axial direction of the fixing member.

14. The fixing device according to claim 13, wherein the nip formation member comprises an outer surface portion provided on an outer surface thereof that faces the nip via the fixing member, and wherein, in a state in which the pressing member does not apply pressure to the nip formation member, the outer surface portion of the nip formation member has a convex shape facing the nip via the fixing member to form a gradually decreasing gap between the nip formation member and the fixing member extending from lateral ends toward a center of the nip formation member in the axial direction of the fixing member.

15. The fixing device according to claim 14, wherein a depth of the concave-shaped support portion of the heater support is substantially equivalent to a height of the convex-shaped outer surface portion of the nip formation member.

16. The fixing device according to claim 15, wherein, in a state in which the pressing member applies pressure to the nip formation member, the convex-shaped outer surface portion of the nip formation member is flattened by the pressing member to cause the nip formation member to contact the fixing member uniformly in the axial direction of the fixing member, and the nip formation member transmits the pressure from the pressing member to the core holder to bend the core holder by an amount equivalent to the height of the convex-shaped outer surface portion of the nip formation member.

17. The fixing device according to claim 16, wherein, in a state in which the pressing member applies pressure to the nip formation member, the bent core holder further transmits the pressure from the pressing member to the heater support to flatten the concave-shaped support portion of the heater support by offsetting the depth of the concave-shaped support portion of the heater support with the height of the convex-shaped outer surface portion of the nip formation member.

* * * * *